US010048640B2

(12) United States Patent
Hano

(10) Patent No.: US 10,048,640 B2
(45) Date of Patent: Aug. 14, 2018

(54) IMAGE FORMING APPARATUS

(71) Applicant: CANON KABUSHIKI KAISHA, Tokyo (JP)

(72) Inventor: Masami Hano, Abiko-shi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/367,774

(22) Filed: Dec. 2, 2016

(65) Prior Publication Data

US 2017/0082969 A1 Mar. 23, 2017

Related U.S. Application Data

(63) Continuation of application No. PCT/JP2015/066956, filed on Jun. 5, 2015.

(30) Foreign Application Priority Data

Jun. 6, 2014 (JP) ..... 2014-117665

(51) Int. Cl.
*G03G 21/00* (2006.01)
*G03G 15/02* (2006.01)
*G03G 21/08* (2006.01)

(52) U.S. Cl.
CPC ..... *G03G 21/0011* (2013.01); *G03G 15/02* (2013.01); *G03G 21/00* (2013.01); *G03G 21/08* (2013.01)

(58) Field of Classification Search
None
See application file for complete search history.

(56) References Cited

U.S. PATENT DOCUMENTS 7,212,771 B2 5/2007 Tanaka et al.
8,090,288 B2 1/2012 Hano
2008/0107447 A1* 5/2008 Patterson ..... G03G 21/08 399/128
2009/0269105 A1* 10/2009 Hano ..... G03G 15/0291 399/171
2010/0158558 A1* 6/2010 Hano ..... G03G 15/0258 399/100

(Continued)

FOREIGN PATENT DOCUMENTS

JP 2003-287940 A 10/2003
JP 2004-325994 A 11/2004

(Continued)

OTHER PUBLICATIONS

JP 2004325994 English machine translation, Miyashita, Nov. 18, 2004.*

(Continued)

*Primary Examiner* — Thomas Giampaolo, II
(74) *Attorney, Agent, or Firm* — Fitzpatrick, Cella, Harper & Scinto

(57) ABSTRACT

An image forming apparatus includes a temperature/humidity sensor 112 for detecting temperature/humidity information and a controller 101 for executing, on the basis of information detected by this detecting means, an operation in a control mode in which charging by a corona charger 2 and discharging by a discharging means 9 are carried out while rotating a photosensitive member after end of cleaning by the cleaning means and before image formation is started.

10 Claims, 13 Drawing Sheets

(56) References Cited

U.S. PATENT DOCUMENTS

2013/0272723 A1* 10/2013 Imazeki ..... G03G 15/5079
399/8

FOREIGN PATENT DOCUMENTS

| | | | |
|---|---|---|---|
| JP | 2005-338797 | A | 12/2005 |
| JP | 2007-121460 | A | 5/2007 |
| JP | 2007-164010 | A | 6/2007 |
| JP | 2009-151121 | A | 7/2009 |
| JP | 2010-151959 | A | 7/2010 |
| JP | 2013-190454 | A | 9/2013 |
| JP | 2014-085400 | A | 5/2014 |

OTHER PUBLICATIONS

International Search Report and Written Opinion dated Jul. 3, 2015, in PCT/JP2015/066956.

* cited by examiner

| | |
|---|---|
| (1) | 0.312±0.03 |
| (2) | 0.071±0.03 |
| (3) | 45° ±1° |
| (4) | 0.1±0.03 |
| (5) | 6.9±0.1 |
| (6) | 1.5±0.1 |

IMAGE FORMING APPARATUS

This is a continuation of PCT/JP2015/066956, filed Jun. 5, 2015, which claims priority to Japanese Patent Application No. 2014-117665, filed Jun. 6, 2014.

TECHNICAL FIELD

The present invention relates to an image forming apparatus for an electrophotographic type and specifically relates to the image forming apparatus, such as a copying machine, a laser beam printer, a process cartridge and the like, using a corona discharging type.

BACKGROUND ART

Conventionally, in the image forming apparatus of the electrophotographic type, an image is formed by an electrophotographic process including charging, exposure, development and transfer. Of these, in a charging step, an electrophotographic photosensitive member (photosensitive member) has been electrically charged uniformly to a potential of a predetermined polarity by a corona charger provided close to the photosensitive member.

The corona charger has a constitution in which a discharge wire (discharging electrode) is extended between blocks as holding members provided at end portions of a shield (shield case) which is a supporting casing having an open (one) surface. The shield is representatively constituted by a stainless steel (hereinafter also referred to as "SUS"). Further, the discharge wire is constituted by a wire material of tungsten or the like. In the case where a surface-to-be-charged of a member-to-be-charged such as an image bearing member is electrically charged using the corona charger, the corona charger is caused to oppose the member-to-be-charged in a state in which an opening of the shield is brought near to the surface-to-be-charged, and a discharge current is supplied to the discharge wire to generate corona discharge, so that electric charges are imparted to the surface-to-be-charged.

A charge potential of the surface-to-be-charged is controlled by providing a grid (grid electrode) between the discharge wire and the image bearing member and by adjusting an amount of the electric charges imparted to the image bearing member by a grid bias applied to the grid. As the grid, principally, a wire-like grid formed of the same material as the discharge wire or of SUS, and a plate-like grid in which many holes are formed by etching or the like.

Incidentally, in the image forming apparatus using the electrophotographic type, the grid of the corona charger for electrically charging the surface of the image bearing member is contaminated with a scattered matter such as an electric discharge product, toner, an external additive or paper powder. Further, in the case where particularly the plate-like grid is used, the holes are clogged with the scattered matter deposited on the grid during corona discharge, whereby a rectifying effect is impaired and therefore potential spots are generated on the image bearing member in some cases. In order to maintain high-quality image formation, it is desired that these discharge spots are remedied and an image defect is prevented.

As regards the above-described scattered matter, it has been proposed that a cleaning member is provided in the corona charger and the scattered matter is removed by the cleaning member. Japanese Laid-Open Patent Application 2005-338797 discloses that the scattered matter deposited on the plate-like grid is removed by the cleaning member.

SUMMARY OF THE INVENTION

Problems to be Solved by the Invention

However, in the case where the above-described cleaning member cleans the plate-like grid, the member-to-be-cleaned can maintain a function by removing the scattered matter, but against the scattered matter dropped during cleaning, no countermeasure was taken. Particularly, when image formation is effected in a high-humidity environment after the cleaning of the grid, the electric discharge product dropped by the cleaning of the grid takes no moisture in the air and deposits on the photosensitive member. It turned out that the surface of the photosensitive member on which the electric discharge product which taken up moisture deposits is rubbed with a blade and thereby a potential charge generates at a portion of the photosensitive member surface opposing the corona charger during the cleaning of the grid and an image defect generates.

An object of the present invention is to provide an image forming apparatus capable of suppressing that the image defect as described above generates after the grid is cleaned by the cleaning member.

Means for Solving the Problem

According to an aspect of the present invention, there is provided an image forming apparatus comprising:

a rotatable photosensitive member;

a corona charger including a plate-like grid electrode provided with a plurality of through holes and configured to electrically charge the photosensitive member at a charging portion;

a toner image forming portion configured to form a toner image on the photosensitive member electrically charged by the corona charger;

a discharging portion configured to discharge the photosensitive member by irradiating the photosensitive member with light;

a blade configured to clean a surface of the photosensitive member by rubbing the surface of the photosensitive member;

a cleaning member configured to clean the grid electrode by rubbing the grid electrode;

a controller configured to effect control so as to execute an operation in a cleaning mode in which the grid electrode is cleaned by the cleaning member at predetermined timing; and an acquiring portion configured to acquire information on an amount of water content in air, wherein an operation of continuously forming toner images on a plurality of recording materials is interrupted and the operation in the cleaning mode is executed and then the operation of continuously forming toner images is resumed, the photosensitive member is rotated for a time period after an end of the operation in the cleaning mode and before the resumption of toner image formation, while charging the photosensitive member by the corona charger and discharging the photosensitive member by the discharging portion, and wherein the controller controls the time period, such that the time period is longer in a case that the amount of water content in air, based on the information acquired by the acquiring portion, is not less than a predetermined value than in a case that the amount of water content in air, based on the information acquired by the acquiring portion, is less than a predetermined value.

According to another aspect of the present invention, there is provided an image forming apparatus comprising:

a rotatable photosensitive member;

a corona charger including a plate-like grid electrode provided with a plurality of through holes and configured to electrically charge the photosensitive member at a charging portion;

a toner image forming portion configured to form a toner image on the photosensitive member electrically charged by the corona charger;

a discharging portion configured to discharge the photosensitive member by irradiating the photosensitive member with light;

a blade configured to clean a surface of the photosensitive member by rubbing the surface of the photosensitive member;

a cleaning member configured to clean the grid electrode by rubbing the grid electrode;

a controller configured to effect control so as to execute an operation in a cleaning mode in which the grid electrode is cleaned by the cleaning member at predetermined timing; and an acquiring portion configured to acquire information on an amount of water content in air, wherein in a case that the amount of water content in air, based on the information acquired by the acquiring portion, is not less than a predetermined value and when the operation in the cleaning mode is executed after toner image formation by the toner image forming portion is ended, the controller effects control such that a mode of the image forming apparatus shifts to a stand by mode in which the image forming apparatus awaits start of image formation by the image forming apparatus by rotating the photosensitive member for a predetermined period in a state in which charging of the photosensitive member by the corona charger and discharging of the photosensitive member by the discharging portion are carried out after the operation in the cleaning mode and then by stopping rotation of the photosensitive member at a time of a lapse of the predetermined value.

According to the present invention, it becomes possible to suppress that the image defect generates after grid cleaning in the high-humidity environment.

EMBODIMENT FOR CARRYING OUT THE INVENTION

In the following, an image forming apparatus according to the present invention will be described in further detail with reference to the drawings.

Embodiment 1

<With Regard to General Structure of Image Forming Apparatus>

Figure 1:
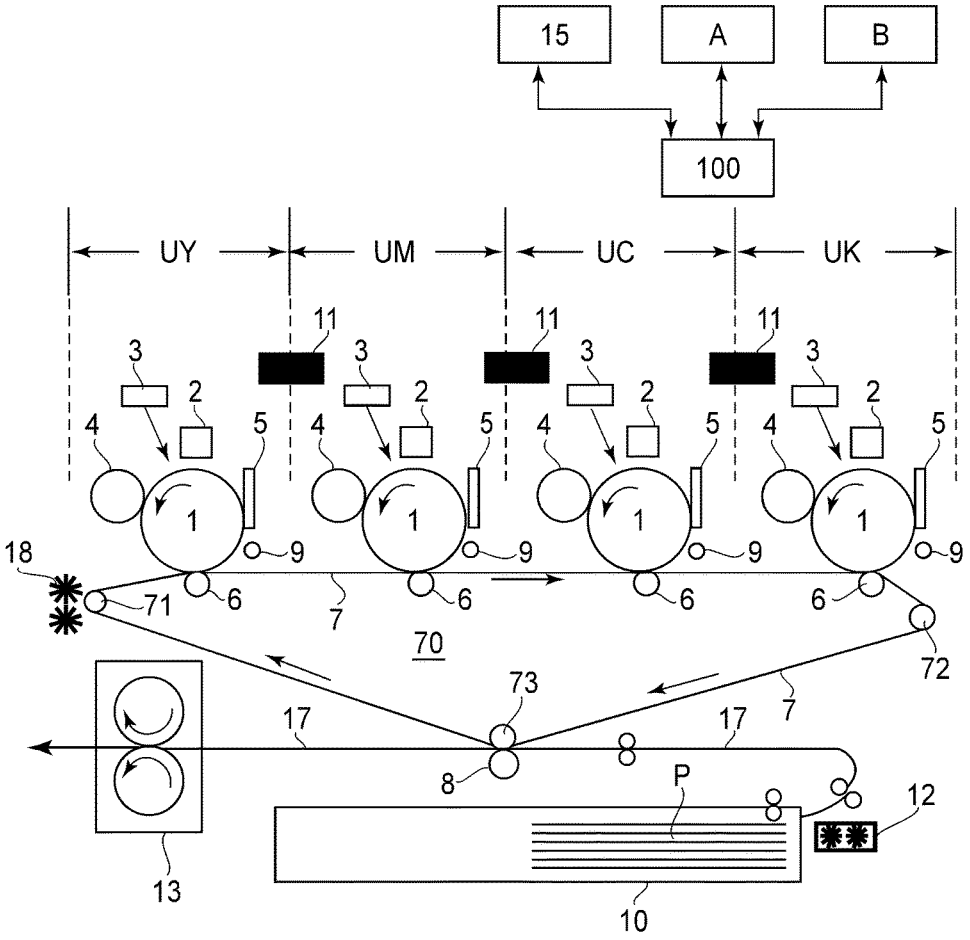
FIG. 1 is a schematic view of an image forming apparatus in Embodiment 1.

A schematic structure of an image forming apparatus in this embodiment will be described using FIG. 1. This image forming apparatus is a full-color electrophotographic image forming apparatus of a tandem type and an intermediary transfer type with four drum-type rotatable photosensitive members 1 as image bearing members.

100 is a controller portion of the image forming apparatus and is an ordinary computer control device which has a calculation function and which is programmed, and totally controls respective portions of the image forming apparatus, so that an image is formed on a recording material (transfer (-receiving) material: hereinafter referred to as a sheet). The controller portion 100 sends and receives electrical information signals between itself and an operating panel 15, an original reading device A, an external device B or the like. The external device B is a personal computer, a network, an image reader, a facsimile machine or the like.

Further, the controller portion 100 effects processing of the electrical information signals inputted from various process devices and sensors in the image forming apparatus, processing of instruction signals to the various process devices, predetermined initial sequence control, predetermined image forming sequence and the like.

In the figure, first to fourth (four) image forming portions U (UY, UM, UC, UK) are arranged in series from a left-hand side to a right-hand side. The respective image forming portions U are only different in color of developers (toners) accommodated in associated developing devices 4 so that the colors are yellow (Y), magenta (M), cyan (C), black (K), respectively, and image forming process mechanisms are the same electrophotographic process mechanism.

Figure 2:
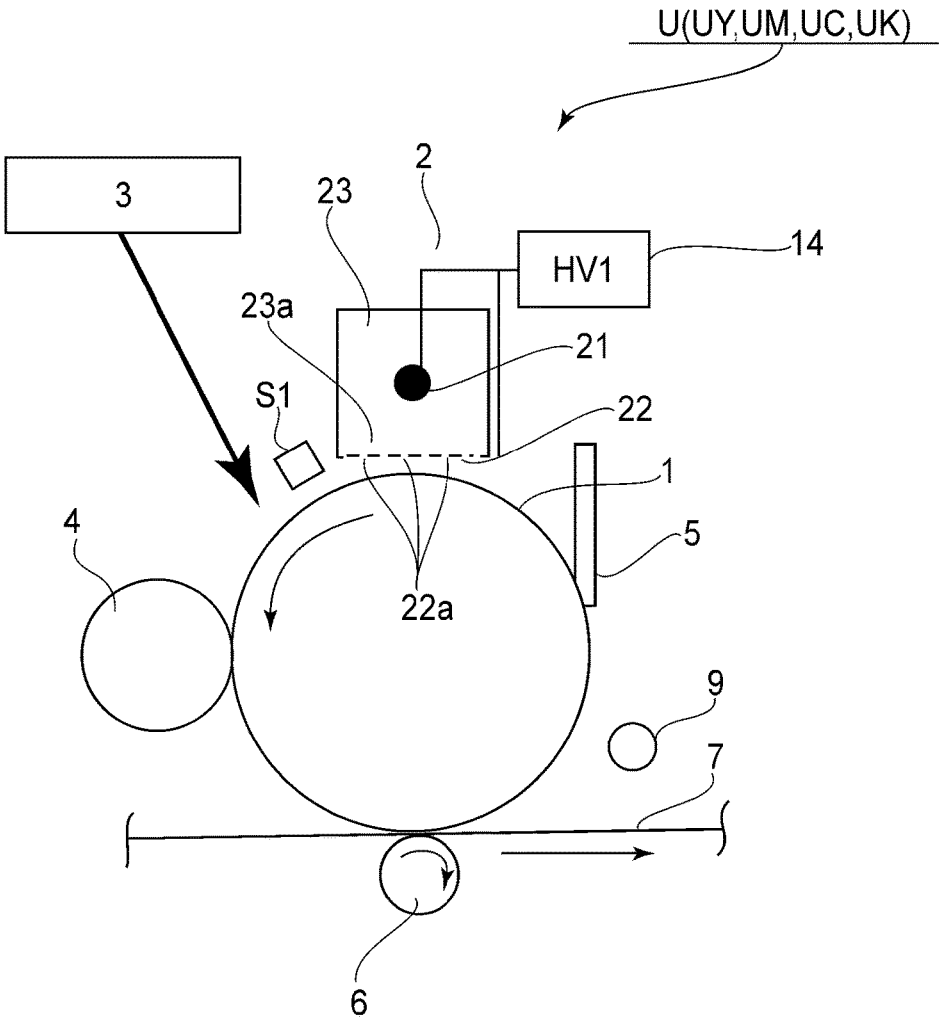
FIG. 2 is a partially enlarged view of FIG. 1.

That is, each image forming portion U includes a photosensitive member 1 and as electrophotographic process means actable thereon, a charger 2, an exposure device 3, a developing device 4, a primary transfer roller 6 as a primary transfer device, a discharging device 9, a cleaning device 5 and the like. The photosensitive member 1 is rotationally driven in the counterclockwise direction of an arrow at a predetermined peripheral speed. FIG. 2 is an enlarged schematic view of a single image forming portion U.

In a side under the first to fourth image forming portions UY, UM, UC, UK, an intermediary transfer unit 70 including an intermediary transfer roller 7 as an intermediary transfer member (transfer-receiving medium) is provided. The belt 7 is an endless belt having flexibility and is extended and stretched among three rollers of a driving roller 71, a tension roller 72 and a secondary transfer opposite roller 73, and is circulated and moved in the clockwise direction of arrows at a speed corresponding to the peripheral speed of the photosensitive member 1.

The primary transfer roller 6 is provided inside the belt 7 and contacts the belt 7 toward a lower surface of the photosensitive member 1. A press-contact portion between the photosensitive member 1 and the belt 7 is a primary transfer nip (transfer portion, transfer position). Toward the secondary transfer opposite roller 73, a secondary transfer roller 8 as a secondary transfer device contacts the belt 7. A press-contact portion between the belt 7 and the secondary transfer roller 8 is a secondary transfer nip.

On the photosensitive member 1 of the first image forming portion UY, a Y (color) toner image corresponding to a Y (color) component of a full-color image to be formed is formed. On the photosensitive member 1 of the second image forming portion UM, an M (color) toner image corresponding to an M (color) component is similarly formed. On the photosensitive member 1 of the third image forming portion UC, a C (color) toner image corresponding to a C (color) component is similarly formed. On the photosensitive member 1 of the fourth image forming portion UK, a K (color) toner image corresponding to a K (color) component is similarly formed.

A toner image forming principle and process on the photosensitive member 1 of each image forming portion U will be described. First, a surface of the rotating photosensitive member 1 is electrically charged at a charging portion by the charger 2. Then, the surface of the photosensitive member 1 charged by the charger 2 is exposed to light by the exposure device 3 as a part of the toner image forming portion depending on an inputted image forming signal, so that an electrostatic image is formed on the surface of the photosensitive member 1. Then, the electrostatic image formed on the surface of the photosensitive member 1 by the exposure device 3 is developed with toner by the developing predetermined value 4 as a part of the toner image forming portion, so that a toner image is formed on the surface of the photosensitive member 1.

The respective color toner images of Y (color), M (color), C (color), K (color) formed on the photosensitive members 1 of the respective image forming portions U are successively transferred superposedly in a predetermined manner onto the surface of the belt 7 which circulates and moves. By this, an unfixed full-color toner image of superposed toner images of the four colors of Y (color)+M (color)+C (color)+K (color) is synthetically formed, and is fed to the secondary transfer nip.

A residual toner image on the photosensitive member 1 from which the residual toner image is not transferred onto the belt 7 is removed by the cleaning device 5. In this embodiment, blade cleaning is applied, but the present invention is not limited thereto, and there is no problem even when a fur brush or the like is added. The discharging device 9 as a discharging portion is a discharging means for effecting discharge of the photosensitive member in a side downstream of the primary transfer nip (transfer portion) and upstream of a charging portion by the charger 2 with respect to a rotational direction of the photosensitive member 1.

On the other hand, a single sheet P is separated and fed from a sheet accommodating device 10 and is introduced into the secondary transfer nip at predetermined control timing by being passed through a feeding path 17. By this, onto a surface of the sheet P, the full-color toner images in the belt 7 side are successively secondary-transferred altogether. Then, the sheet P coming out of the secondary transfer nip is separated from the surface of the belt 7 and passes through the feeding path 17, and is introduced into a fixing device 13.

The fixing device 13 nips and feeds the sheet P at a fixing nip formed by fixing members and fixes the unfixed toner image as a fixed image by heat and pressure. The surface of the belt 7 after sheet separation is cleaned by a belt cleaning device 18 and is repetitively subjected to image formation.

<Image Bearing Member>

In this embodiment, as the photosensitive member 1 as the image bearing member, a rotatable drum-type electrophotographic photosensitive member is used. This photosensitive member 1 includes a photosensitive layer formed of a negatively chargeable OPC (organic photoconductor (organic optical semiconductor)). The photosensitive member 1 is 84 mm in diameter and is 370 mm in length with respect to a longitudinal direction. This photosensitive member 1 is rotationally driven in the counterclockwise direction of the arrow in FIG. 1 at a process speed (peripheral speed) of about 350 mm/sec.

Further, the photosensitive member 1 in this embodiment assumes a layer structure of an ordinary organic photosensitive member. Specifically, the photosensitive member 1 includes an aluminum-made cylinder, which is an electroconductive support, at an inside thereof with respect to a radial direction. On this cylinder, an undercoat layer for suppressing light interference due to the cylinder and for not obstructing transportation of electric charges generating in upper layers. Further, an injection preventing layer for suppressing passing of holes generating in the upper layers and for permitting passing of only electrons, a charge generating layer for generating electric charges by light irradiation, a charge transporting layer for transporting the electric charges, and a surface protective layer for improving a cleaning property are provided.

The surface protective layer applied in this embodiment is formed by curing through irradiation with electron beams. The surface protective layer has high durability by being cured, but on the other hand, problems due to shuddering, turning-up, rubbing (sliding) of the cleaning blade 5 occur. In this embodiment, in order to prevent occurrence of the above-described problems, a value of universal hardness (HU) of a peripheral surface of the photosensitive member is made not less than 150 $N/m^2$, whereby a cleaning property in repetitive use can be maintained. Incidentally, in this embodiment, the photosensitive member of not less than 150 $N/m^2$ and not more than 220 $N/m^2$ in universal hardness was used.

In this embodiment, the voltage of the universal hardness (HU) of the peripheral surface of the photosensitive member is a voltage measured using a microhardness device ("FISCHERSCOPE H100V", manufactured by Fischer Instruments K.K.) in an environment of 25° C./50%. This device is a device in which an indenter is contacted to an object-to-be-measured (peripheral surface of the photosensitive member) and a load is continuously applied to this indenter, and then a successive hardness is acquired by directly reading a pressing depth under the load.

In this embodiment, as the indenter, a Vickers quadrangular pyramid diamond indenter with an angle between opposite faces of 136° was used and was pressed against the peripheral surface of the photosensitive member, and a final load of the load continuously applied to the indenter was 6 mN and a time in which a state in which the final load was applied to the indenter is kept was 0.1 sec. Further, the number of measuring points was 273 points.

The voltage of the universal hardness (HU) was calculated by a formula shown below. $F_f$ is the final load, $S_f$ is a surface area of a pressed portion of the indenter when the final load is applied, and $h_f$ is the pressing depth of the indenter when the final load is applied.

$$HU = \frac{F_f[N]}{S_f[\mathrm{mm}^2]} = \frac{6\times10^{-3}}{26.43\times(h_f\times10^{-3})^2}$$

<Charger (Non-Contact Charging Member)>

In the following, a corona charger (scorotron) as the charger 2 in this embodiment will be described. The corona charger 2 in this embodiment includes, as shown in FIG. 2, a discharging wire (discharging electrode) 21 and an electroconductive shield 23 which is provided so as to surround this discharging wire and which has a U-shape in cross-section. Further, the corona charger 2 includes a plate-like grid electrode 22 including a plurality of through holes 22*a* provided at an opening 23*a* of the shield 23. The corona charger 2 is a device for which a direction along the discharging wire 21 is a longitudinal direction.

The charger 2 is provided opposed to the photosensitive member 1 so that the longitudinal direction thereof is parallel with a generatrix of the photosensitive member 1 and so that the opening 23*a* where the grid electrode 22 is provided is spaced from the photosensitive member 1 by a predetermined interval. A charger installation position of the photosensitive member 1 is the charging position.

As (a material of) the discharging wire 21, stainless steel, nickel or tungsten may preferably be used. In this embodiment, of metals, the tungsten having very high stability was used as (the material of) the discharging wire. By using the tungsten as the discharging wire 21, in a service condition such as in an environment of heating and ozone, stable corona discharge can be effected, so that the discharging wire 21 can be stably used for a long term.

The discharging wire 21 is held with a certain tension by an adjusting screw (unshown) provided integral with the electroconductive shield 23 which performs an electrical shielding action and which is formed of the stainless steel (hereinafter referred to as SUS). Further, the discharging wire 21 and the shield 23 are kept electrically insulating by a holding member (unshown) formed of an insulating material.

The discharging wire 21 may preferably be 40 μm-100 μm in diameter. When the diameter of the discharging wire 21 is excessively small, the discharging wire 21 is cut by collision of ions due to electric discharge in some cases. On the other hand, when the diameter of the discharging wire 21 is excessively large, in order to obtain stable corona discharge, a voltage applied to the discharging wire 21 increases. When the applied voltage is high, ozone is liable to generate and occurrence probability of image flow becomes high, and in addition, a problem such that a power (voltage) source cost increases generates.

In this embodiment, as the discharging wire 21, a tungsten wire of 60 μm in diameter was used. As regards the electric charge generating the corona discharge by the discharging wire 21, a rectifying effect is generated by bias control of the grid electrode 22 connected with a high-voltage source (high-voltage means: constant-voltage source) 14 controlled by the controller portion 100. By this, an amount of the electric charges imparted to the photosensitive member 1 is adjusted, so that a charging potential is controlled.

As the grid electrode 22, a grid electrode in which a plurality of openings (through holes) 22*a* are formed in a mesh shape is provided. A base material of the grid electrode 22 used in this embodiment is a 0.03 mm-thick metal plate which is formed of austenitic stainless steel (SUS 304) and is provided with a plurality of openings 22*a* formed by etching. The grid electrode 22 subjected to etching has a mesh shape at an inside thereof.

Figure 3:
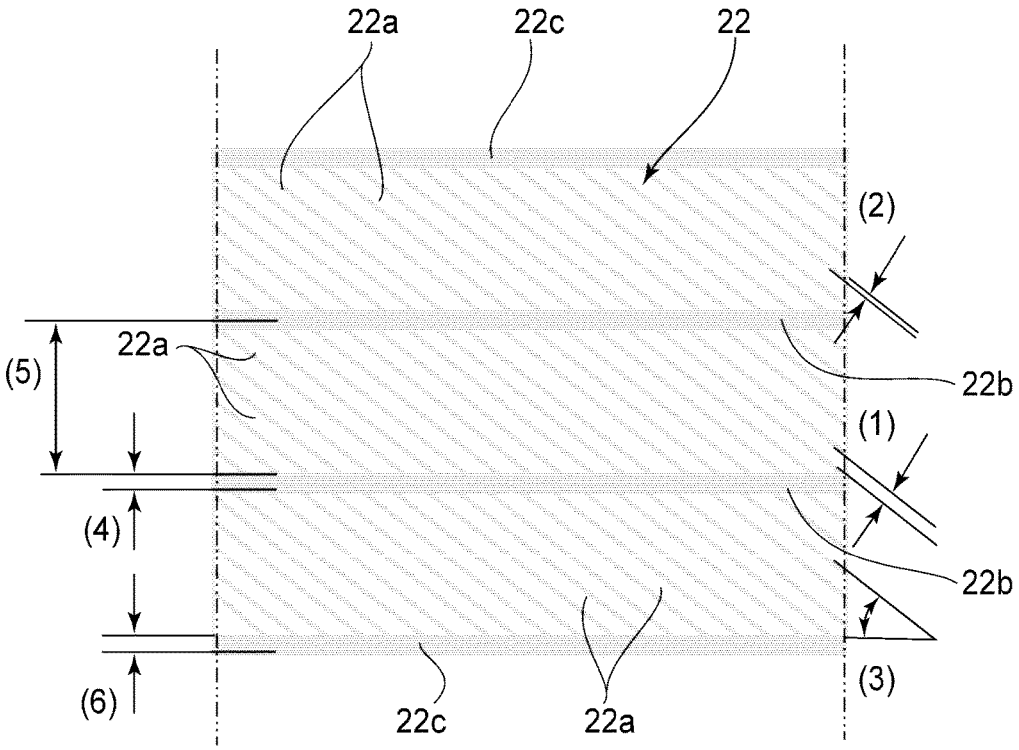
FIG. 3 is a partially enlarged plan view of a grid electrode.

In FIG. 3, a partially enlarged view of the grid electrode 22 was shown. The mesh openings 22*a* are formed so as to have an inclination angle (3): 45±1° with respect to a base line H (line parallel with a grid electrode longitudinal direction in a flat plane of the grid electrode 22) and a width (2): 0.07±0.03 mm with an interval of an opening width (1): 0.312±0.03 mm. The grid electrode 22 is provided, in order to prevent flexure (bending), with a beam 22*b* having a width (4): 0.1±0.03 mm is formed along the electrode longitudinal direction every width (interval) (5): 6.9±0.1 mm. An outer frame 22*c* in the electrode longitudinal direction has a width (6): 1.5±0.1 mm.

The grid electrode 22 may preferably include a coating film containing at least carbon atoms as a surface layer thereof. In this embodiment, the grid electrode 22 includes the surface layer formed of tetrahedral amorphous carbon (hereinafter referred to as "ta-C") on the base material formed of SUS. That is, the grid electrode 22 has the surface layer constituted by the coating film containing ta-C.

ta-C was applied in this embodiment as a material which is chemically active to the electric discharge product generating by the corona discharge and which is excellent in corrosion resistance. In the following, the base material formed of SUS is referred to as an "SUS base material", and the surface layer formed by ta-C is referred to as a "ta-C layer". The grid electrode 22 using the ta-C layer is capable of suppressing oxidation of the SUS base material and generation of electrolytic corrosion, so that stable charging with less charging non-uniformity can be maintained for a long term.

Incidentally, the material of the base material is not limited to the above-described austenitic stainless steel (SUS 304), but another austenitic stainless steel may also be used. Further, other stainless steel materials such as martensitic stainless steel and ferrite stainless steel may also be used. Further, even when the material of the surface layer is used, there is no problem unless the base material has the influence on the charging property even when the base material is subjected to plating or surface layer process through plasma treatment.

With the corona charger 2, the high-voltage source 14, controlled by the controller portion 100, for applying the charging bias is connected, and applies biases to the discharging wire 21 and the grid electrode 22. The biases applied from the high-voltage source 14 have the function of uniformly charging the surface of the photosensitive member 1 to a negative(-polarity) potential. Specifically, the biases are controlled so that the discharging wire 21 is subjected to constant-current control with a current of −1 mA and so that the grid electrode 22 is subjected to constant-voltage control with a voltage of about −900 V during ordinary image formation (in this embodiment, hereinafter referred to as an operation in a first mode).

<Exposure Device>

The exposure device 3 as a part of the toner image forming portion is a laser beam scanning exposure device using a semiconductor laser light source and a polygon mirror optical system. For example, a charge potential of the photosensitive member 1 under application of −1 mA to the discharging wire 21 in the constant-current control and application of −900 V to the grid electrode 22 is about −800 V. The surface of the charged photosensitive member 1 charges in surface potential to about −300 V by the exposure. By this, the electrostatic image is formed on the photosensitive member surface by a potential contrast between a dark portion potential and a light portion potential.

<Developing Device>

The developing device 4 as a developing means as a part of the toner image forming portion supplies the developer (toner) to the electrostatic image on the photosensitive member 1 and visualizes the electrostatic image as the toner image. In this embodiment, the above-described exposure device 3 and developing device 4 are the toner image forming portion for forming the toner image on the surface of the photosensitive member 1 charged by the corona charger 2.

As the developing device 4, a reverse-developing device of a two-component magnetic brush developing type was applied. The developing device 4 includes a developing container and a developing sleeve. In the developing container, a two-component developer is accommodated. The two-component developer is a mixture of the toner and a carrier. The two-component developer in which the toner and the carrier are mixed in a proportion of about 8:92 in weight ratio and a toner content (TD ratio) is 8% is used.

The toner is a toner which is obtained by kneading a pigment in a resin binder principally formed of polyester and by pulverizing and classifying the kneaded mixture and which has an average particle size of about 6μ. As regards the carrier, for example, in a surface-oxidized region, unoxidized metals such as iron, nickel, cobalt, manganese, chromium, rare earth element and the like, alloys of these metals, oxide ferrite, and the like may suitably be usable, and a manufacturing method of these magnetic particles is not particularly limited.

The carrier is 20-50 μm, preferably 30-40 μm in volume-average particle size and is $10^7$ Ω·cm or more, preferably $10^8$ Ω·cm or more in resistivity. In this embodiment, a carrier obtained by coating a silicone resin material on a core principally formed of ferrite is used and is 35 μm in volume-average particle size, $5\times10^8$ Ω·cm in resistivity and 200 emu/cc in amount of magnetization.

The developing sleeve is provided opposed to the photosensitive member 1 so as to be close to the photosensitive member 1 in a state in which the closest distance to the photosensitive member 1 is kept at 250 μm. An opposing portion between the photosensitive member 1 and the developing sleeve is a developing portion. The developing sleeve is rotationally driven at a surface thereof in the same direction as a surface movement direction of the photosensitive member 1 at the developing portion. The developing sleeve includes a magnet roller in an inside thereof, and by a magnetic force of the magnet roller, the two-component developer is rotated and fed to the developing portion with rotation of the developing sleeve.

A magnetic brush layer formed on the surface of the developing sleeve is rectified in a predetermined thin layer by a developer coating blade, and the developing sleeve, a predetermined developing bias is applied from a developing bias applying voltage source (unshown) controlled by the controller portion 100.

During an operation in a first mode, the developing bias applied to the developing sleeve is an oscillating voltage including a DC voltage and an AC voltage which are superposed. Specifically, when the charge potential on the photosensitive member 1 is −800 V, the DC voltage of −620 V and the AC voltage of 1300 Vpp with a frequency of 100 kHz were applied.

By an electric field by the developing bias, the toner in the two-component developer is selectively deposited correspondingly to the electrostatic image on the photosensitive member 1. By this, the electrostatic image is developed as the toner image. At this time, a charge amount of the toner with which the electrostatic image is developed on the photosensitive member 1 is about 40 μC/g. The developer on the developing sleeve passed through the developing portion is returned to a developer stagnation portion in the developing container with subsequent rotation of the developing sleeve.

<Primary Transfer Device>

In this embodiment, as a transfer means of the toner image on the photosensitive member 1, the intermediary transfer (member) belt 7 and the primary transfer roller 6 were applied. The primary transfer roller 6 is press-contacted to the belt 7 toward the surface of the photosensitive member 1, and a press-contact portion therebetween is the primary transfer nip. As the primary transfer roller 6, one having a resistance value of $1\times10^2$-$1\times10$Ω/□ during application of +2 kV in a measurement environment of 23° C. in temperature and 50% in humidity. In this embodiment, an ion-conductive sponge roller which is formed by mixing nitrile rubber with ethylene-epichlorohydrin copolymer and which is 16 mm in outer diameter and 8 mm in core metal diameter was used.

<Intermediary Transfer Belt>

The intermediary transfer belt 7 is fed while being nipped between the photosensitive member 1 and the primary transfer roller 6. As the intermediary transfer member used in this embodiment, a belt including an elastic layer having a soft surface was employed in order to meet diversified recording materials. The above-described belt 7 prevents transfer voids of the sheet P having surface unevenness and prevents improper transfer which is called "voids" which are liable to generate on coated paper, OHP paper or the like.

The belt 7 has a 3-layer structure of a base material, an elastic layer and a coat layer and is about 360 μm in total thickness. The base material is constituted by an electroconductive polyimide resin material of 80-90 μm in thickness. The elastic layer is formed by laminating a chloroprene rubber in a thickness of 200-300 μm on the base material and is 60 degrees in JIS-A hardness. The coat layer ensures a parting property of the carried toner particles and the recording material and is an outermost layer of 5-15 μm in thickness in which a fluorine-containing resin material is dispersed in a polyurethane resin material. The resistances of the belt 7 are adjusted so that a volume resistivity is $1\times10^9$-$1\times10^{11}$ Ω·cm and a surface resistivity is $1\times10^{11}$-$1\times10^{13}$Ω/□.

During image formation, to the primary transfer roller 6, a transfer bias voltage (for example, +1500 V) of a positive polarity which is an opposite polarity to a negative polarity which is a normal charge polarity of the toner is applied from a transfer bias applying voltage source (unshown) controlled by the controller portion 100. By this, the toner images are successively transferred electrostatically from the photosensitive members 1 onto the surface of the belt 7.

In this embodiment, a belt press-contact portion (primary transfer nip) of the photosensitive member 1 is a transfer portion, and the primary transfer roller 6 is a transfer means for transferring the toner image, formed on the photosensitive member 1 by the above-described toner image forming means 3, 4, onto the intermediary transfer belt 7 as the transfer-receiving medium at the transfer portion.

<Operation Sequence of Image Formation>

Figure 11:
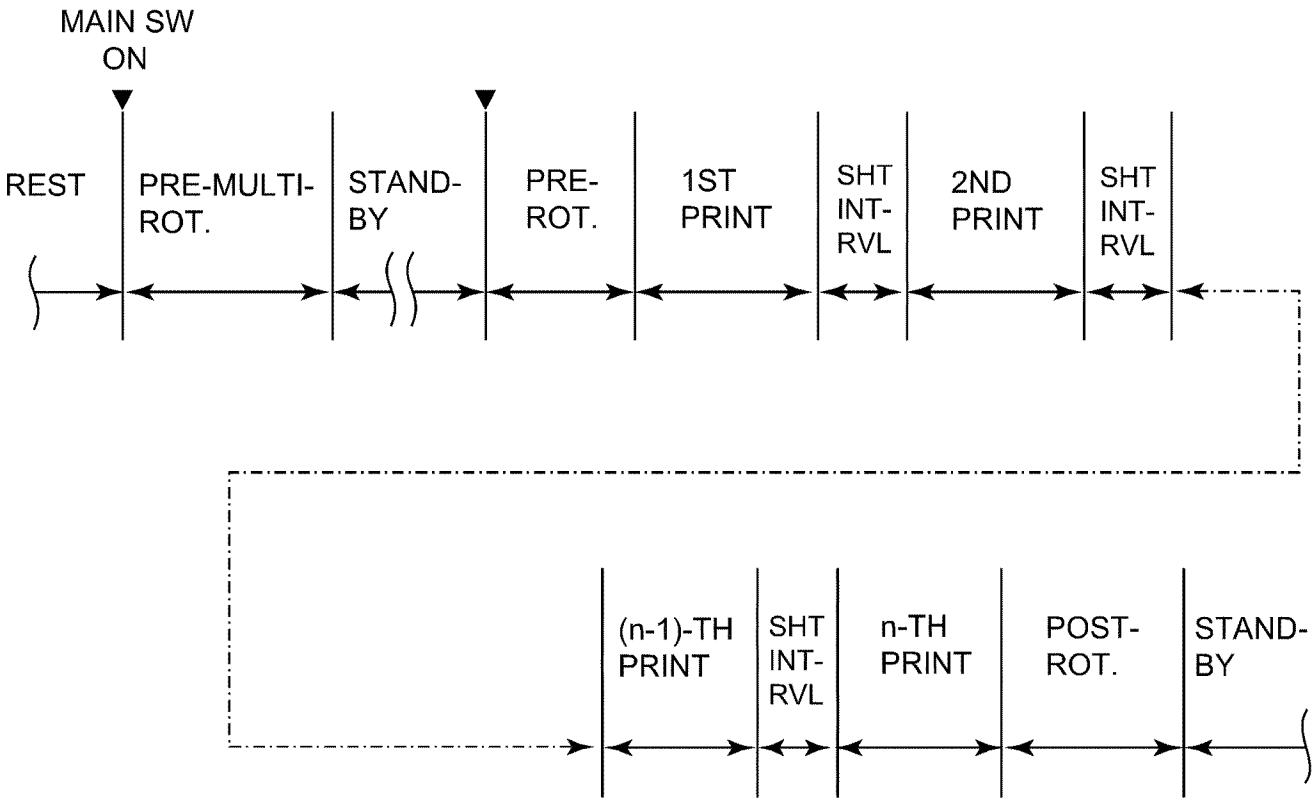
FIG. 11 is a chart showing an operation sequence of image formation of an image forming apparatus in an embodiment.

FIG. 11 is an operation sequence diagram of the image forming apparatus. Using FIG. 11, the operation sequence of the image forming apparatus executed by the controller portion 100 will be described below.

a. Initial Rotation Operation (Pre-Multi-Rotation Step)

This period is a starting operation period (actuation operation period, warming period) during main switch (power source) actuation of the image forming apparatus. When a main power source switch MSW (FIG. 8) of the operating panel portion 15 is turned on, the controller portion 100 actuates a main motor M1 (FIG. 5) and drives the photosensitive member 1 and the intermediary transfer unit 70. Further, the controller portion 100 executes a preparatory operation of predetermined process devices, such as rising of the fixing device 13 to a predetermined temperature and the like.

At this time, the controller portion 100 rotates the photosensitive member 1 while charging the photosensitive member 1 by the control 2 and detects the potential of the charged photosensitive member 1 by a potential sensor Si (FIG. 2). Then, the controller portion 100 effects adjustment of the voltage applied to the discharge electrode 21 of the control 2 and the voltage applied to the grid electrode 22 on the basis of a result of detection.

Further, a value of a current flowing through the primary transfer roller 6 under application of the transfer bias is detected in this period in a state in which the photosensitive member 1 is charged. Then, also ATVC control (Active Transfer Voltage Control) in which adjustment of the primary transfer bias is made so that a detected current value is a predetermined value is effected.

b. Print Preparatory Rotation Operation (Pre-Rotation Step)

This period is a preparatory rotation operation period, before the image formation, from print signal-on to actual execution of an image forming (printing) step operation, and is executed subsequently to the initial rotation operation when the print signal is inputted during the initial rotation operation. When the print signal is not inputted, drive of the main motor M1 is once stopped after an end of the initial rotation operation, and drive of the photosensitive member 1 and drive of the intermediary transfer unit 70 are stopped, so that the image forming apparatus is kept in a stand-by state until the print signal is inputted. When the print signal is inputted, the print preparatory rotation operation is executed.

c. Printing Step (Image Forming Step, Imaging Step)

When the predetermined print preparatory rotation operation is ended, subsequently, an image forming (imaging) process on the photosensitive member 1 is executed, so that the transfer of the toner image formed on the photosensitive member surface onto the sheet P and the fixing process of the toner image by the fixing device 13 are carried out and an image-formed product is printed out. In the case of an operation in a continuous printing (continuous print) mode, the above-described printing step is repetitively executed correspondingly to a predetermined set print sheet number n.

d. Sheet Interval Step

This period is a period from an end of formation of the toner image on the photosensitive member 1 corresponding to a single sheet P to start of formation of the toner image on the photosensitive member 1 corresponding to a subsequent sheet P.

e. Post-Rotation Operation

This period is a period in which the drive of the main motor M1 is continued for a while even after an end of the printing step for a final sheet P, so that the drive of the photosensitive member 1 and the drive of the intermediary transfer unit 70 are driven and a predetermined post-operation is executed.

f. Stand-by

When the predetermined post-rotation operation is ended, the drive of the main motor M1 is stopped, and the drive of the photosensitive member 1 and the drive of the intermediary transfer unit 70 are stopped, so that the image forming apparatus is kept in a stand-by state as an operation in a stand-by (waiting) portion in which the image forming apparatus awaits start of image formation until the subsequent print start signal is inputted. In the case of printing of only a single sheet, after an end of the printing, the image forming apparatus is in the stand-by state after the post-rotation operation. In the stand-by state, when the print start signal is inputted, the printer goes to the pre-rotation step.

In this embodiment, during the pre-rotation of the above-described b and during the printing step of c during image formation, and the initial rotation operation in a, the sheet interval step of d and the post-rotation operation of e are performed during non-image formation.

<Cleaning Control Mechanism of Charger>

Figure 4:
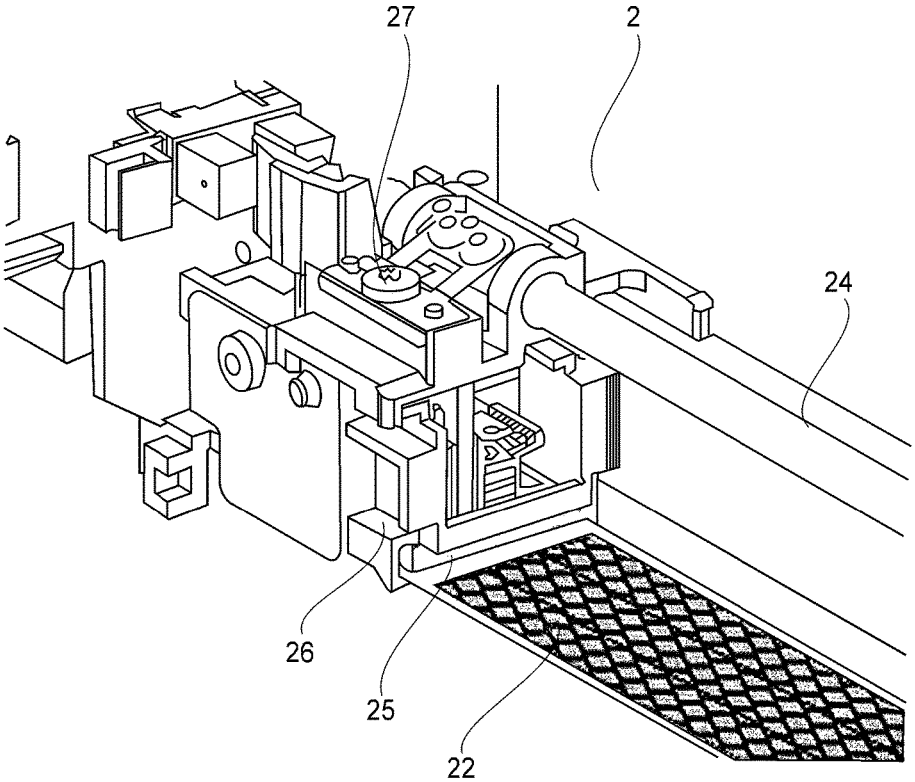
FIG. 4 is an illustration of a cleaning mechanism of a corona charger.

A cleaning control mechanism of the charger 2 will be described using FIG. 4. In this embodiment, a cleaning member 25 for removing the electric discharge product deposited on the grid electrode 22 is provided. The cleaning member 25 is disposed so as to be capable of cleaning a surface (inner surface side of the grid) of the grid electrode 22 in the charging wire 21 side. That is, a horizontal direction length (length of the grid with respect to a widthwise direction) is designed so as to be longer than a length of a region where the mesh openings (through holes) 22*a* of the grid electrode 22 with respect to the widthwise direction.

In this embodiment, as the cleaning member 25, a brush cleaning member formed by providing a brush on a surface layer of a base material and by weaving fibers into a base fabric was used. The cleaning member 25 is constituted in a shape of being spaced from the grid electrode 22 during non-cleaning, and reciprocates in a longitudinal direction of the grid electrode 22 by a driving mechanism while entering the grid electrode 22 in a certain amount only during the cleaning. The cleaning member 25 is attached integrally to a carriage 26 and can be moved in the longitudinal direction of the grid electrode 22 by a screw shaft 24.

The screw shaft 24 which is a rotatable member as a drive transmission member is provided with a spiral groove, and a driving motor M2 (FIG. 5) as a driving source is connected with the screw shaft 24. Then, when the screw shaft 24 is rotationally driven by the driving motor M2, a connecting member 27 as a drive-receiving portion in a state of being threadably mounted on the screw shaft 24 moves in a main scan direction along the spiral groove of the screw shaft 24.

Here, the main scan direction is a rotational axis direction of the photosensitive member 1, i.e., the longitudinal direction of the grid electrode 22. The connecting member 27 can move only the main scan direction on a rail (unshown) provided on the shield 23, so that rotation of the connecting member 27 together with the screw shaft 24 is prevented.

Accordingly, when the screw shaft 24 is driven and rotated in a forward direction by the driving motor M2, a moving force is transmitted to the cleaning member 25 via the carriage 26 provided integrally with the connecting member 27. Then, the cleaning member 25 moves forward while rubbing (sliding on) the grid electrode 22 along the longitudinal direction of the grid electrode 22. When the cleaning member 25 reaches an end (point) of the forward movement, the driving motor M2 is charged in drive to reverse rotation, so that the cleaning member 25 moves backward while rubbing the grid electrode 22 along the longitudinal direction of the grid electrode 22. By the rubbing of the grid electrode 22 by this reciprocal movement of the cleaning member 25 along the longitudinal direction of the grid electrode 22, cleaning of the grid electrode 22 is made.

As timing when the cleaning of the grid electrode 22 is executed by the cleaning member 25, it is possible to cite the following timing. It is possible to cite before execution of the pre-multi-rotation step at the time when the main power source switch MSW of the image forming apparatus is turned on and during the post-rotation step after the printing of a predetermined print (sheet) number. Further, it is possible to cite during the sheet interval when the printing of the predetermined print number is made and when an operator arbitrarily presses a switch 16 (FIG. 8) for providing an instruction to start the cleaning through the operating panel 15.

<Control Circuit>

Figure 5:
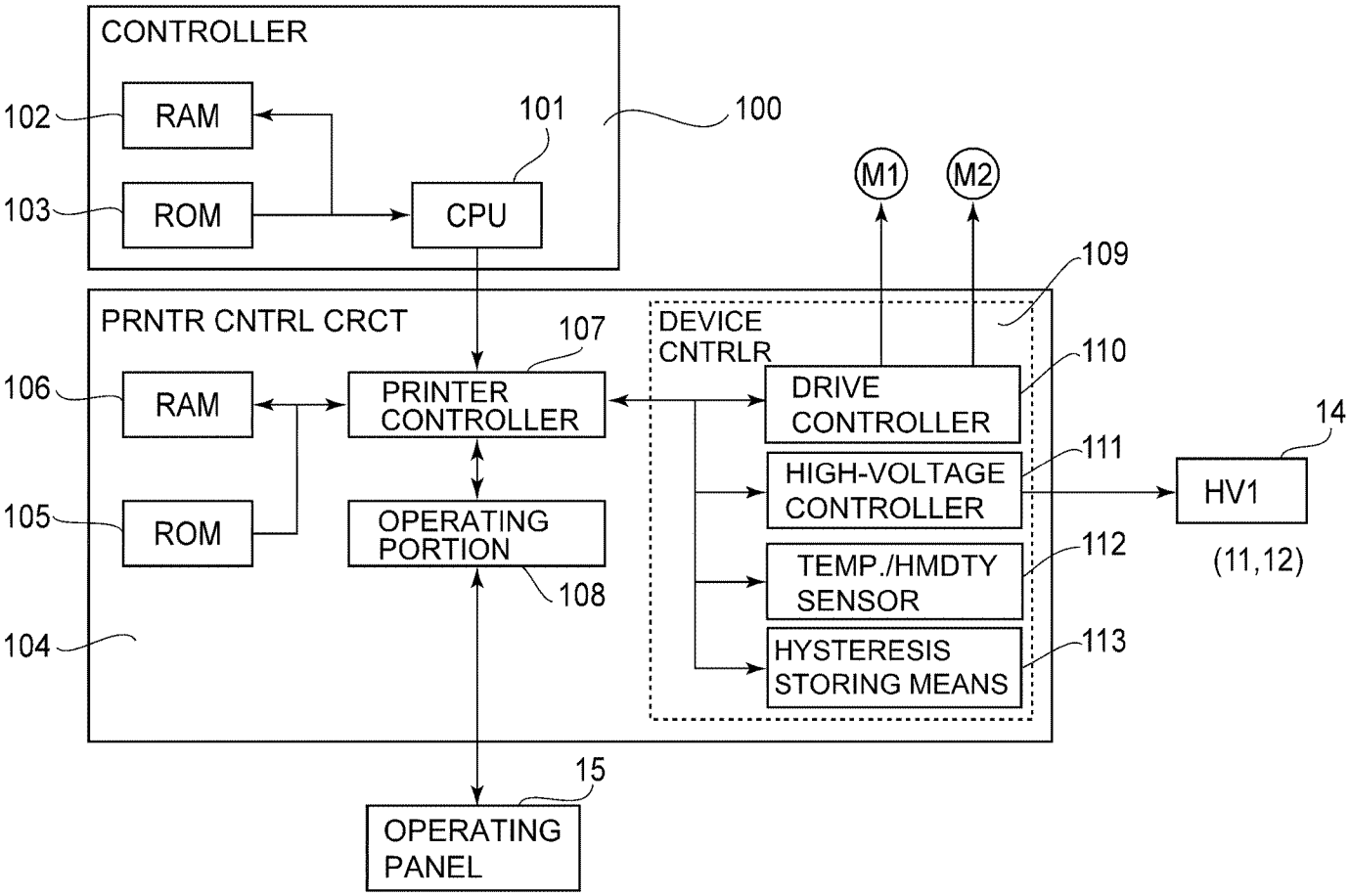
FIG. 5 is a control circuit diagram.

Next, a control circuit for controlling the image forming apparatus will be described. FIG. 5 is a hardware block diagram for illustrating a connection relationship of CPU (central processing unit) 101 for controlling the image forming apparatus with the respective portions. The image forming apparatus is controlled by the controller portion 100 for effecting control (management) of a job and by a printer control portion 104 for controlling a printer portion in order to form image data as a visible image on the sheet. Here, the job is a series of image forming operations on a single or a plurality of sheets by a single image forming operation start instruction.

The controller 100 includes CPU 101, ROM 103 in which a control program is written, RAM 102 for storing data for executing processes, and the like. These portions are connected by a bus and can exchange pieces of information with each other.

The printer control portion 104 controls the printer portion (each image forming portion) and executes basic control of the image forming operation. The printer control portion 104 includes a printer controller 107, ROM 105 in which a control program is written, RAM 106 for storing data for executing processes of the image forming operation, an operating portion 108, and the like. These portions are connected by a bus and can communicate with each other. Here, in the ROM 105, a program for executing a flow for controlling cleaning control of the photosensitive member in this embodiment is stored.

A predetermined value controller 109 is an electric circuit containing input/output parts for controlling respective constituent parts of the printer portion. The device controller 109 includes a drive controller 110 for controlling the main motor M1 and the driving motor M2 for moving the grid cleaning member 25, and the like. Further, the device controller 109 includes a high-voltage controller 111 for making proper high-voltage setting during the cleaning control of the photosensitive member, and a temperature/humidity sensor 112, as a detecting means, for detecting temperatures and humidities at an inside and an outside of the image forming apparatus.

Further, the device controller 109 includes a hysteresis storing means 113 as a counting means for storing a cumulative sheet number of sheets subjected to the image formation by the image forming apparatus and a change with time of a use status or the like of the charger 2.

In this embodiment, the CPU 101 can calculate an absolute water content in the air from a detection result of the temperature/humidity sensor 2 (FIG. 1) for detecting the temperature and humidity in an installation environment of the image forming apparatus. That is, in this embodiment, the temperature/humidity sensor 12 is an acquiring portion for acquiring information on a water content in the air. The printer controller 107 may also have a similar function. Incidentally, image defect largely depend on the absolute water content, and therefore instead of the absolute water content in the installation environment, even when a humidity sensor (FIG. 1) in the image forming apparatus is used, there is no problem. The temperature/humidity sensor 112 in FIG. 5 is shown as an integrated portion of the above-described temperature and humidity sensors 12 and 11 in FIG. 1.

<Photosensitive Member Cleaning Control>

By effecting the above-described cleaning of the grid electrode 22, the scattered matter drops and deposits on the photosensitive member 1. The scattered matter dropped on the photosensitive member 1 includes the toner, an external additive, dust particles and the electric discharge product in many cases. These scattered matters are rubbed with the members 7 and 5 contacting the photosensitive member 1 and cause one type of triboelectric charge, so that carriers are generated inside the photosensitive member. Particularly, a foreign matter such as the ta-C layer is not readily deposited on the surface layer of the grid electrode, and in the case where a constitution in which a parting property during the cleaning is good, the scattered matter dropping on the photosensitive member 1 during the cleaning of the grid electrode increases in amount.

As regards the scattered matter at a portion where the scattered matter dropped on the photosensitive member 1, the scattered matter is rubbed and scraped off by the cleaning device 5, but the carriers generated on the photosensitive member 1 cannot be removed by the drive in a high-voltage non-application state. For that reason, the potential at the portion where the scattered matter is deposited is an abnormal potential during subsequent image formation, with the result that the portion is visualized as the image defect.

According to an experiment by the present inventor, in the case where an ambient absolute water content is not less than a predetermined value, specifically in the case where the ambient absolute water content is not less than 12 g/kg DryAir, the above-described image defect occurs. Further, in the case where the ambient absolute water content is less than the predetermined value, specifically in the case where the ambient absolute water content is less than 12 g/kg DryAir, the above-described image defect did not occur.

Figure 6:
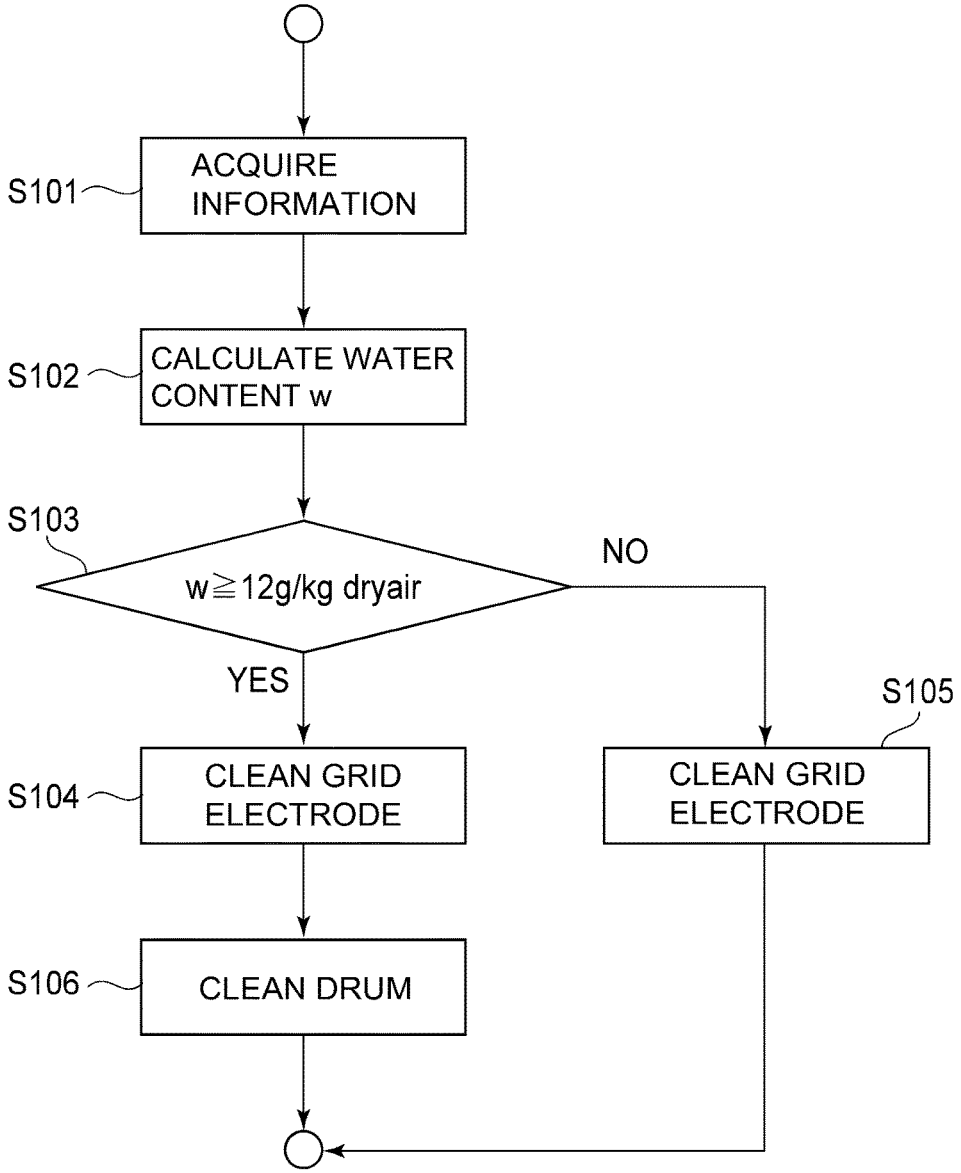
FIG. 6 is a control flowchart in Embodiment 1.

In this embodiment, the detecting means 112 for detecting temperature/humidity information of the image forming apparatus is provided. Further, the control means 101 for carrying out, on the basis of the input by this detecting means 112, a cleaning operation in the photosensitive member 1 for not only removing the scattered matter deposited on the photosensitive member 1 but also restoring the abnormal potential at the scattered matter deposited portion after an end of the cleaning of the grid electrode 22 with the cleaning member 25 is provided. Detailed embodiments will be successively described later as to a control flow and a high voltage condition. First, the control flow for carrying out the cleaning control (operation in a photosensitive member cleaning control mode) of the photosensitive member in this embodiment will be described. FIG. 6 shows a flowchart in this embodiment.

As a starting condition (as a reference time associated with cleaning control start) of the control of the cleaning by the cleaning member 25 in a pre-stage for carrying out the cleaning control of the photosensitive member, it is possible to cite the following times. That is, there are times of an end of the charging of the photosensitive member 1 by the charger 2, an end of the image exposure by the exposure device 3, a stop of the rotation of the photosensitive member 1, forced interruption of control during the image formation, and the like. In this embodiment, the time of the forced interruption of the control during the image formation was applied. The CPU 101 as the controller controls the respective portions in the following manner in accordance with the program stored in the ROM 103.

S101: At timing when the cleaning of the grid electrode 22 is executed, the CPU 101 acquires the temperature/humidity information in the installation environment of the image forming apparatus from the temperature/humidity sensor 112 in the device control portion and transmits the temperature/humidity information to the CPU 101 via the printer controller 107.

S102: The CPU 101 calculates an absolute water content W on the basis of the acquired temperature/humidity information.

S103: The CPU 101 executes a discriminating process as to whether or not the absolute water content W in the environment in which the image forming apparatus is installed is not less than 12 g/kg DryAir.

That is, the CPU 101 includes a functional portion as a discriminating means for discriminating the contents of the information detected by the temperature/humidity sensor 112, and discriminates whether the water content acquired from the information detected by the temperature/humidity sensor 112 is not less than a predetermined value or less than the predetermined value.

S104: In the case where W is not less than 12 g/kg DryAir, the CPU 101 controls the printer controller 107 to execute an instruction to carry out the cleaning control for cleaning the grid electrode 22.

S105: In the case where W is less than 12 g/kg DryAir, the CPU 101 controls the printer controller to execute the following instruction. That is, the CPU 101 controls the printer controller 107 to execute an instruction to carry out the cleaning control for cleaning the grid electrode 22 and does not carry out a subsequent process, and controls the printer controller 107 to execute an instruction of a stand-by state.

That is, the CPU 101 rotates, on the basis of a discrimination result of the functional portion as the discriminating means, the photosensitive member 1 after the end of the cleaning by the cleaning means 25 and before start of the image formation. Then, by effecting the charging by the corona charger 2 and the discharging by the discharging means 9, not only the cleaning of the photosensitive member 1 but also an operation in the control mode for restoring the abnormal potential generated on the photosensitive member 1 are carried out.

The CPU 101 effects control so as to execute the operation in the control mode in the case where discrimination, as the amount of water content based on the information detected by the detecting means, of the functional portion as the discriminating means is not less than a predetermined value. In the case where the discrimination is less than the predetermined value, control is effected so as not to execute the operation in the control mode. When the execution of the operation in the control mode is ended, the CPU 101 causes the image forming apparatus to effect the image formation or to go to the stand-by mode awaiting the start of the image formation.

Here, the stand-by state is the following state. The image forming apparatus forms the image on the sheet P for an inputted printing job (image signal). After an end of the image formation, the image forming apparatus goes to the stand-by state.

In the stand-by state, the temperature of the fixing device 13 is controlled at a stand-by temperature lower than a fixing temperature so that when a subsequent printing job is inputted, a time to the image formation becomes relatively short (operation in the stand-by mode). Alternatively, in the stand-by state, energization to the fixing device 13 by which much electric power is consumed (operation in low electric power consumption mode). A constitution in which the image forming apparatus is in the stand-by mode from after the end of the image formation to a lapse of a predetermined time and the mode is changed from the stand-by mode to the low electric power consumption mode after the lapse of the predetermined time from the end of the image formation may also be employed.

S106: After the cleaning control of the grid electrode 22 in S104 is executed, the CPU 101 controls the printer controller 107 to execute an instruction to effect an operation in a photosensitive member cleaning control mode for effecting cleaning of the photosensitive member 1.

The cleaning control of the photosensitive member in this embodiment will be described in detail using FIG. 7. The cleaning control of the photosensitive member in this embodiment is control for preventing the image defect generated by the scattered matter dropped on the photosensitive member 1 after the end of the cleaning control of the grid electrode 22 by the cleaning member 25.

Specifically, in a state in which the high voltage is applied to the charger 2 and the photosensitive member 1 is charged while rotating the photosensitive member 1 and the belt 7, the surface of the charged photosensitive member is passed through the transfer means 6 without applying the high voltage to the transfer means 6 and is subjected to the discharging step by the discharging device 9, and is recharged again. This operation is repeated. By rotating the photosensitive member 1 for a predetermined time, the abnormal potential generated on the photosensitive member 1 is restored, so that the above-described problem can be prevented.

Figure 7:
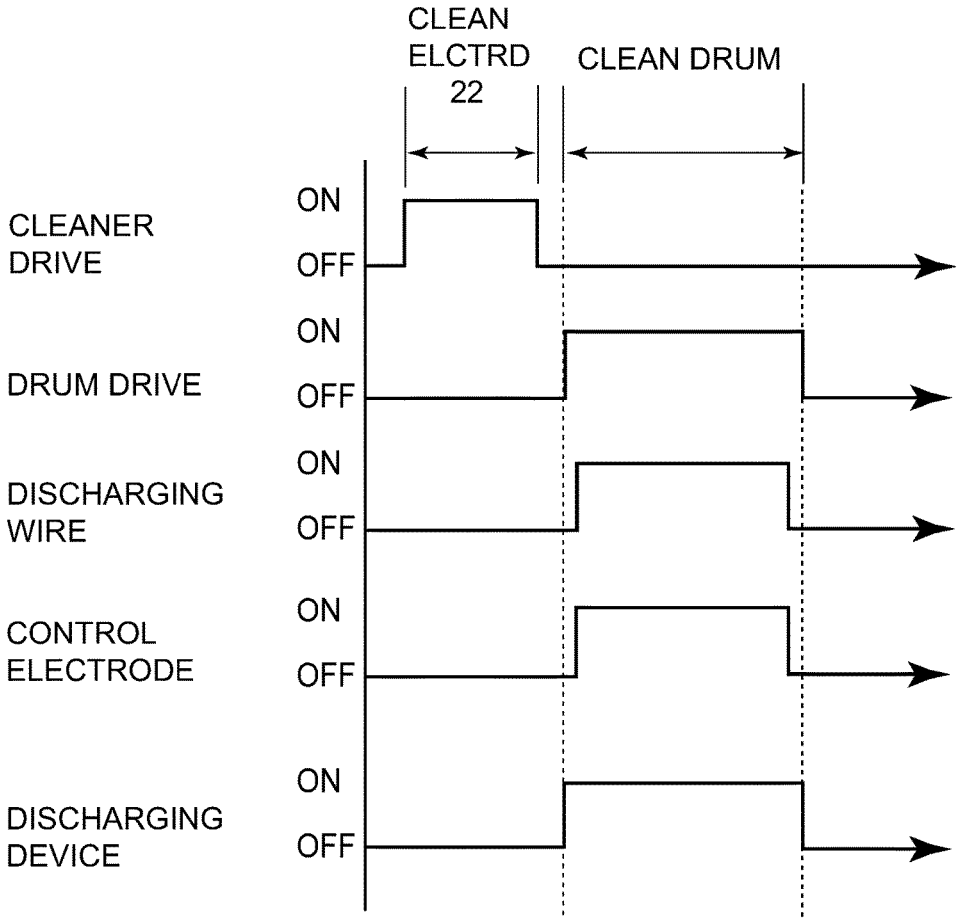
FIG. 7 is a chart showing high-voltage application timing in Embodiment 1.

FIG. 7 is a diagram showing a high-voltage flow based on the premise that the cleaning control of the photosensitive member is carried out by the flowchart of FIG. 6. After the end of the cleaning drive of the grid electrode 22, the photosensitive member 1 is driven (also the belt 7 is driven). After drive stabilization time, simultaneously with application of a predetermined constant current to the discharging wire 21 of the corona charger 2 by the high-voltage means 14, a predetermined constant voltage is applied to the grid electrode 22 by the high-voltage means 14. In this embodiment, a photosensitive member moving speed was about 350 mm/s, the current applied to the discharging wire 21 was the constant current of −1 mA, the voltage applied to the grid electrode 22 was the constant voltage of −800 V, and a driving time was 20 sec.

In this embodiment, the above-described driving speed, high-voltage condition and driving time were set, but the present invention is not limited thereto. As regards the above-described problem, when drive rotation in the high-voltage application state is carried out during the cleaning control of the photosensitive member, an effect is achieved even when numerical values are changed unless productivity or the like is considered.

In this embodiment, a portion of the photosensitive member 1 where the electric discharge product is deposited is triboelectrically charged by the cleaning of this grid electrode 22, whereby the carriers generated and remained on the photosensitive member 1 are caused to generate electric charge movement and pair annihilation by charging the photosensitive member 1. By this, the surface potential of the photosensitive member 1 can be normally refreshed.

The image forming apparatus in this embodiment is summarized as follows. The rotatable photosensitive member 1 and the plate-like grid electrode 22 including the discharge electrode 21 for effecting the discharge and the plurality of through holes 22*a* are provided, and the corona charger 2 for charging the photosensitive member 1 at the charging portion and the cleaning means 25 for cleaning the grid wire by contacting the grid electrode 22.

Further, the toner image forming means 3, 4 for forming the toner image on the surface of the photosensitive member 1 charged by the corona charger 2 and the transfer means 6 for transferring the toner image formed on the surface of the photosensitive member 1 onto the transfer-receiving medium 7 are provided. Further, the discharging means 9 for discharging the photosensitive member 1 in a side downstream of the transfer portion and upstream of the charging portion with respect to the rotational direction of the photosensitive member 1 is provided.

Further, the detecting means 112 (11, 12) for detecting the temperature/humidity information and the control means 101 as the controller for executing the operation in the following control mode (photosensitive member cleaning control mode) on the basis of the information detected by the detecting means 112 are provided. That is, the control means 101 executes the operation in the control mode in which not only the photosensitive member 1 is rotated but also the charging by the control 2 and the discharging by the discharging means 9 are effected after the end of the cleaning by the cleaning means 25 and before the start of the image formation.

Further, the control means 101 effects control so as to execute the operation in the above described control mode in the case where the amount of water content based on the information detected by the detecting means 112 is not less than the predetermined value and so as not to execute the operation in the above described control mode in the case where the amount of water content is less than the predetermined value. Further, the control means 101 causes the image forming apparatus to effect the image formation or to go to the stand by mode awaiting start of the image formation when the execution of the operation in the control mode is ended.

As described above, according to this embodiment, on the basis of the temperature/humidity information, after the end of the cleaning by the above-described cleaning means 25, by including the control means 101 for carrying out the cleaning control of the photosensitive member 1, it becomes possible to prevent the image defect generating by the drop of the scattered matter on the photosensitive member 1 in a specific environment.

Incidentally, in this embodiment, the cleaning control of the photosensitive member 1 is effected at cleaning timing of the grid electrode 22. However, in the case where the charging is made in a state in which the photosensitive member 1 is rotated with not less than 20S in adjustment of the voltage applied to the corona charger 2 or adjustment of the transfer bias after the cleaning of the grid electrode 22 in the above-described pre-rotation step, the cleaning control of the photosensitive member may also be not effected separately.

Embodiment 2

Basic constitution and operation in an image forming apparatus in Embodiment 2 are the same as those in Embodiment 1. Accordingly, elements having the same or corresponding functions and constitutions are represented by adding the same reference numerals or symbols and will be omitted from description. In embodiment 1, setting was made on the basis of during the forced interruption of the control during the image formation, but, it is desirable that this embodiment is applied also after the grid cleaning member 25 is driven and controlled by an operation (manual operation) by a user (operator) during stand-by, for example.

Figure 8:
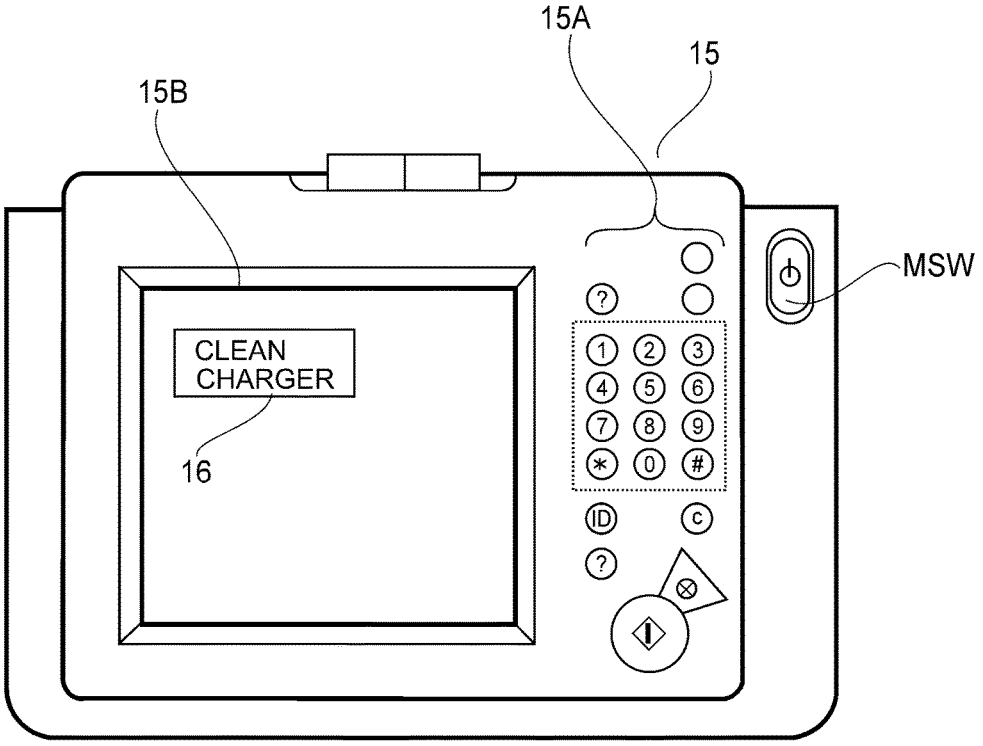
FIG. 8 is a schematic view of an operating panel.

FIG. 8 shows the operating panel 15 attached to the image forming apparatus in this embodiment. The operating panel 15 is provided at a proper position of the image forming apparatus and is a means for inputting various pieces of information to the controller portion 100 by the user, and includes an operating button portion 15A and a display portion (information display portion) 15B. At the operating button portion 15A, various settings of the printing operation performed by the image forming apparatus are made.

The display portion 15B is a liquid crystal screen of a touch panel type, and not only display of various pieces of information but also display of various operating buttons are made, so that the user can select desired items on the screen. Then, by pressing (touching) the operating buttons, so that various settings of the operation performed by the image forming apparatus are inputted.

In this embodiment, by pressing a charger cleaning selection button 16 displayed at the display portion 15B, an instruction from the operating portion 108 in FIG. 5 in the printer controller 107 and the CPU 101 is carried out, so that the device controller 109 carries out a desired operation.

In this embodiment, by pressing the charger cleaning selection button 16 displayed at the display portion 15B of the operating panel 15, the cleaning by the grid cleaning member 25 is carried out. Thereafter, on the basis of the flow shown in FIG. 6, enable/disable discrimination as to whether or not the cleaning of the photosensitive member is carried out after the end of the cleaning. As regards the cleaning control of the photosensitive member, the control is carried out similarly as in the control in Embodiment 1.

According to this embodiment, on the basis of the temperature/humidity information, after the end of the cleaning by the above-described cleaning means 25, by including the control means 101 for discharging whether or not the cleaning control of the photosensitive member is carried out, it becomes possible to prevent the image defect generating by the drop of the scattered matter on the photosensitive member 1 in a specific environment.

Embodiment 3

Basic constitution and operation in an image forming apparatus in Embodiment 3 are the same as those in Embodiment 1. Accordingly, elements having the same or corresponding functions and constitutions are represented by adding the same reference numerals or symbols and will be omitted from description.

In Embodiment 3, there is no problem even when in addition to the cleaning discrimination enabling or disabling of the cleaning control of the photosensitive member on the basis of the temperature/humidity information, an energization time (cumulative charging time by the corona charger 2) to the grid electrode 22 is taken into consideration. Rather, even when the cleaning control of the photosensitive member is effected in a fresh state of the image forming apparatus, no scattered matter is deposited in the case of a new one of the image forming apparatus, and therefore, the control is useless control from the viewpoint of productivity.

It is clear from past findings that the influence by the drop of the scattered matter tends to be no good with a change with time. In the case where the image forming apparatus in this embodiment is used, in the image forming apparatus using the grid electrode 22, it is known that this phenomenon generates in the following case, for example. That is, when a solid image ratio of A4-sized plain paper (basis weight: 80 g) in a high temperature/high humidity environment (30° C./80%) is 100%, in the case where a continuous durability test is made at an image ratio of 10%, this phenomenon generates at about 300 k sheets (about 60 hour-energization conversion).

Figure 9:
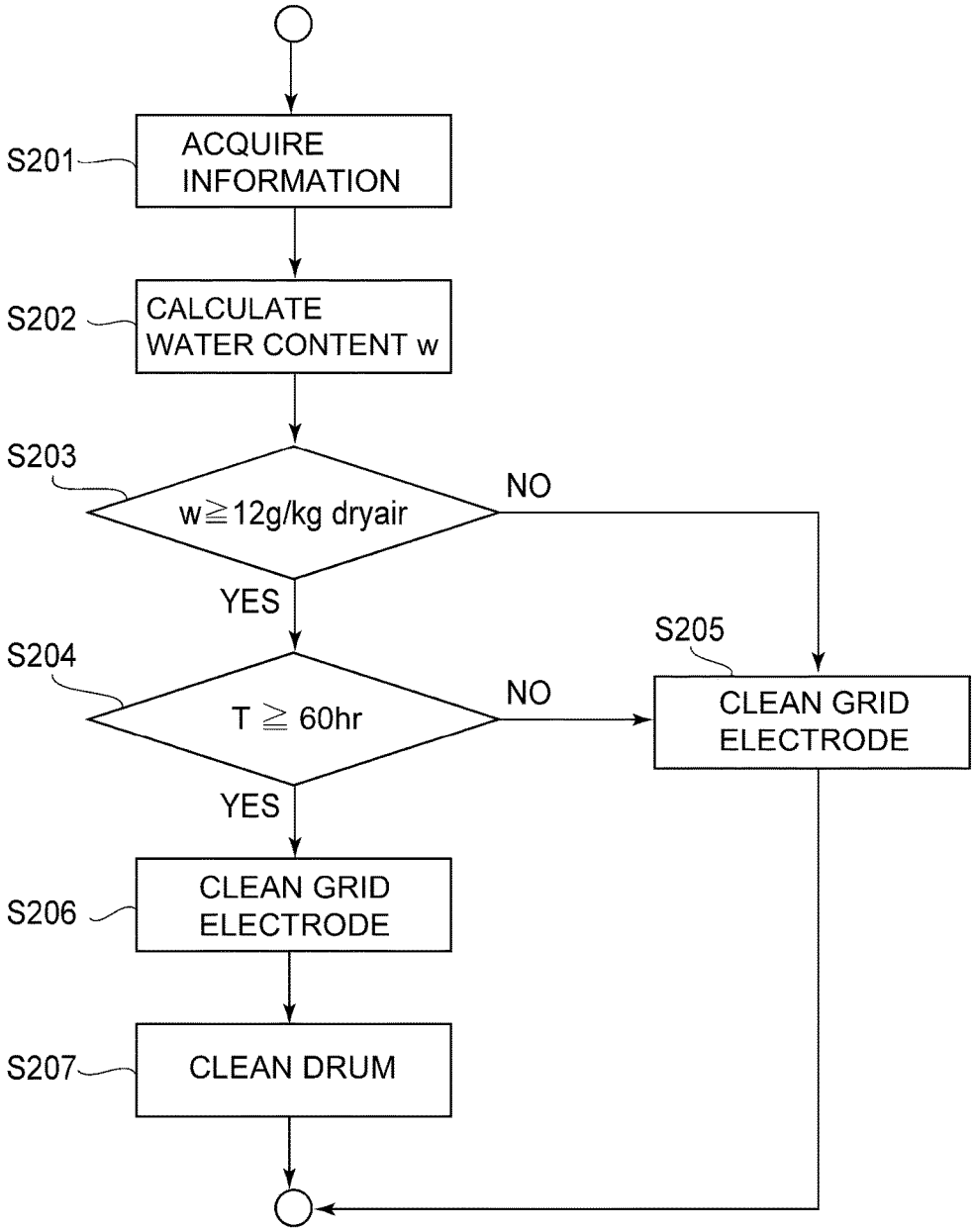
FIG. 9 is a control flowchart in Embodiment 3.

Therefore, in this embodiment, on the basis of a control flowchart shown in FIG. 9, enable/disable discrimination as to whether or not the photosensitive member cleaning control is carried out after the end of the cleaning is made. Control of respective portions in FIG. 9 will be described.

S201: The CPU 101 acquires the temperature/humidity information in the installation environment of the image forming apparatus from the temperature/humidity sensor 112 in the device control portion and transmits the temperature/humidity information to the CPU 101 via the printer controller 107.

S202: The CPU 101 calculates an absolute water content W on the basis of the acquired temperature/humidity information.

S203: The CPU 101 executes a discriminating process as to whether or not the absolute water content W in the environment in which the image forming apparatus is installed is not less than 12 g/kg DryAir.

That is, similarly as in Embodiment 1, the CPU 101 includes a functional portion as a discriminating means for discriminating the contents of the information detected by the temperature/humidity sensor 112. Then, the CPU 101 discriminates whether the amount of water content based on the information detected by the temperature/humidity sensor 112 is not less than a predetermined value or less than the predetermined value.

S204: In the case where W is not less than 12 g/kg DryAir, the CPU 101 transmits an instruction to the printer controller 7 to acquire a time of application of the high voltage to the grid electrode 22 by the hysteresis storing means (charging time acquiring portion) 113. Here, the hysteresis storing means 113 acquires and stores the time of energization to the grid electrode as information corresponding to the charging time by the corona charger 2.

S205: In the case where W is less than 12 g/kg DryAir, the CPU 101 controls the printer controller to execute the following instruction. That is, the CPU 101 controls the printer controller 107 to execute an instruction to carry out the cleaning control for cleaning the grid electrode 22 and does not carry out a subsequent process, and controls the printer controller 107 to execute an instruction of a stand-by state.

S206: In the case where, a cumulative (integrated) high-voltage application time T to the grid electrode 22 is not less than 60 hours, an instruction to carry out the cleaning control for cleaning the grid electrode 22 is provided. In the case where the cumulative application time is less than 60 hours, the instruction to carry out the cleaning control for cleaning the grid electrode 22 is provided and subsequent processes are not carried out, so that an instruction to cause the printer controller 107 to place the image forming apparatus in the stand-by state is provided.

S207: The CPU 101 executes an instruction of the photosensitive member cleaning control to the printer controller 107 after the end of the execution of the cleaning of the grid electrode.

That is, the CPU 101 effects control in the following manner on the basis of discrimination of the functional portion as the discriminating means as to the amount of water content based on the information detected by the detecting means 112 and the cumulative charging time acquired by the charging time acquiring means 113. That is, the CPU 101 effects the control so as to execute the operation in the above-described control mode in the case where the above-described amount of water content is not less than a predetermined value and the cumulative charging time acquired by the charging time acquiring means 113 is not less than a predetermined time. Further, the CPU 101 effects the control so as to execute the operation in the above-described control mode in the case where the cumulative charging time acquired the charging time acquiring means 1113 is less than the predetermined time.

As regards the photosensitive member cleaning control, the control is effected similarly as in the control shown in Embodiment 1. According to this embodiment, on the basis of the temperature/humidity information, after the end of the cleaning by the above-described cleaning means 25, in addition to discrimination as to whether or not the photosensitive member cleaning control is carried out, whether or not the photosensitive member cleaning control is effected on the basis of the grid electrode energization time is discriminated. By this, it is possible to prevent a lowering in productivity due to unnecessary photosensitive member cleaning control and to prevent the image defect, generating due to the scattered matter drop on the photosensitive member in the specific environment, which is the problem in this embodiment.

The image forming apparatus in this embodiment is summarized as follows. The image forming apparatus further includes the charging time acquiring means 113 for acquiring the information corresponding to the cumulative charging time by the corona charger 2. The control means 101 executes the operation in the control mode on the basis of the information acquired by the charging time acquiring means 113. The charging time acquiring means 113 acquires the time of energization to the grid electrode 22 as information corresponding to the charging time by the corona charger 2.

The control means 101 executes the operation in the above described control mode in the case where the amount of water content based on the information detected by the detecting means 112 is not less than the predetermined value and the cumulative charging time acquired by the charging time acquiring means 113 is not less than the predetermined time. In the case where the cumulative charging time acquired by the charging time acquiring means 113 is less than the predetermined time, the control means 101 effects control so as not to execute the operation in the above described control mode.

Incidentally, in this embodiment, the integrated time of energization to the grid electrode 22 was taken into consideration, but there is no problem, even when a durable sheet number (cumulative value of sheets subjected to sheet passing) is provided as a discrimination criterion, and further, the discrimination may also be made on the basis of the durable sheet number or a cumulative energization time of the charger 2 itself.

Embodiment 4

Next, another embodiment of the present invention will be described. Basic constitution and operation in an image forming apparatus in this embodiment are the same as those in Embodiment 1. Accordingly, elements having the same or corresponding functions and constitutions are represented by adding the same reference numerals or symbols and will be omitted from description.

In this embodiment, in addition to the photosensitive member cleaning control discrimination enabling and disabling on the basis of the temperature and humidity detection, the case where control in which also charging by the corona charger 2 is made in the state in which the photosensitive member 1 is rotated as adjusting control by an operation other than the image forming operation performed after the cleaning control was interrupted was assumed. Further, discrimination enabling and disabling as to whether or not the photosensitive member cleaning control is carried out on the basis of a control time thereof was made. At this adjusting control, for example, it is possible to cite control for adjusting the voltage applied to the corona charger 2 as effected in the above-described pre-rotation step and the above-described ATVC control.

Figure 10:
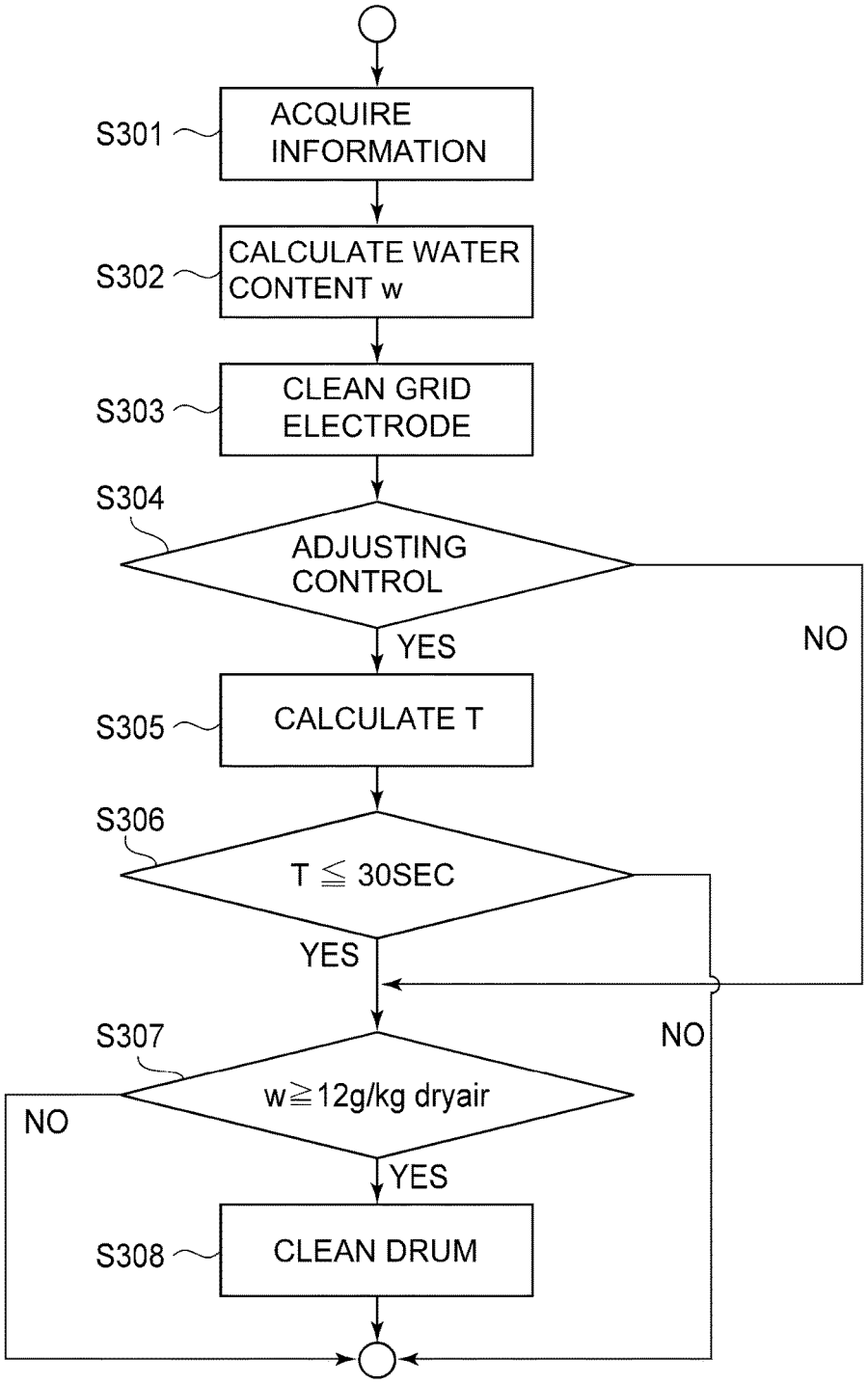
FIG. 10 is a control flowchart in Embodiment 4.

By applying this embodiment, if countermeasure control for preventing the image defect is effected for a certain time in an adjusting time by the adjusting control other than the image formation, there is no need to carry out the photosensitive member cleaning control. For that reason, there is no need to carry out excessive photosensitive member cleaning control, and therefore compared with the above-described embodiments, the productivity is not influenced. FIG. 10 shows a control flow in this embodiment, respective portions will be described later.

S301: The CPU 101 acquires the temperature/humidity information in the installation environment of the image forming apparatus from the temperature/humidity sensor 112 in the device control portion and transmits the temperature/humidity information to the CPU 101 via the printer controller 107.

S302: The CPU 101 calculates an absolute water content W on the basis of the acquired temperature/humidity information.

S303: The CPU 101 transmits a cleaning execution instruction of the grid electrode 22 to the printer controller 107.

S304: The CPU 101 discriminates whether or not the adjusting control other than the image formation is carried out after the end of the cleaning control. In the case where the control is not carried out, the sequence goes to the flow immediately before S307.

S305: The CPU 101 measures a time to an end of the control by using the hysteresis storing means 113 and stores the time in the RAM 106 in the case where the adjusting control is carried out.

S306: The CPU 1010 discriminates whether or not the time to the end of the control is ended within 20 sec.

S307: The CPU 101 executes a discriminating process as to whether or not the absolute water content W in the environment in which the image forming apparatus is installed is not less than 12 g/kg DryAir. In the case where the absolute water content is less than 12 g/kg DryAir, the control is not carried out, and the state goes to the stand-by state or the image formation.

S308: In the case where W is not less than 12 g/kg DryAir, the CPU 101 transmits an instruction to the printer controller 7 to acquire a time of application of the high voltage to the grid electrode 22 by the hysteresis storing means 113. As regards the photosensitive member cleaning control, the control is carried out similarly as in control shown in Embodiment 1.

Incidentally, in the adjusting control other than the image formation control in this embodiment, at least a condition similar to that in the photosensitive member cleaning control is contained, so that an element such that the photosensitive member 1 is rotated and the photosensitive member 1 is charged by the charging means 2 is included.

When the above-described requirement is included in the adjusting control, the control may also be carried out in parallel to image adjusting control using the exposure means or high-voltage optimization using the transfer means. That is, in the case where adjustment of the image forming condition is made by rotating the photosensitive member 1 and charging the photosensitive member 1 by the corona charger 2 after the end of the cleaning by the cleaning means 25 and before the start of the image formation, the control means 101 effects control so as not to execute the operation in the above-described control mode.

According to this embodiment, in the case where the adjusting control other than the cleaning control by the cleaning means 25 and the normal image formation is carried out after the end of the cleaning control by the cleaning means 25, on the basis of a time when the above-described control is carried out, the above-described photosensitive member cleaning contact is not carried out. By this, a lowering in productivity due to unnecessary photosensitive member cleaning control can be prevented. And, by carrying out the photosensitive member cleaning control at a necessary time, it becomes possible to suppress the image defect that otherwise occurs after the grid cleaning in the high-humidity environment, which is the problem.

In Embodiments 1 to 3, the rotational speed of the photosensitive member 1 is not mentioned, but in the case where a constitution in which the rotational speed of the photosensitive member 1 is capable of being variably changed to a plurality of stages (levels) is employed, the cleaning control of the photosensitive member 1 in this embodiment may also be effected at the fastest (highest) rotational speed of the plurality of stages. The productivity can be improved by effecting the cleaning control of the photosensitive member 1 in this embodiment at the fastest rotational speed of the plurality of stages.

Further, a condition of the voltage applied to the control in the cleaning control of the photosensitive member 1 in this embodiment may also be set so as to be different from that during the normal image formation. For example, the voltage applied to the grid electrode is changed to a voltage larger in absolute value than that during the normal image formation, whereby even when the time when the cleaning control of the photosensitive member 1 is executed is shortened, a similar effect can be obtained, so that the productivity can be improved.

Embodiment 5

Next, another embodiment of the present invention will be described. In this embodiment, a point such that the discharging device 9 is not provided is different from Embodiments 1 to 4. Another basic constitution and operation in an image forming apparatus in Embodiment 2 are the same as those in Embodiment 1. Accordingly, elements having the same or corresponding functions and constitutions are represented by adding the same reference numerals or symbols and will be omitted from description.

Figure 12:
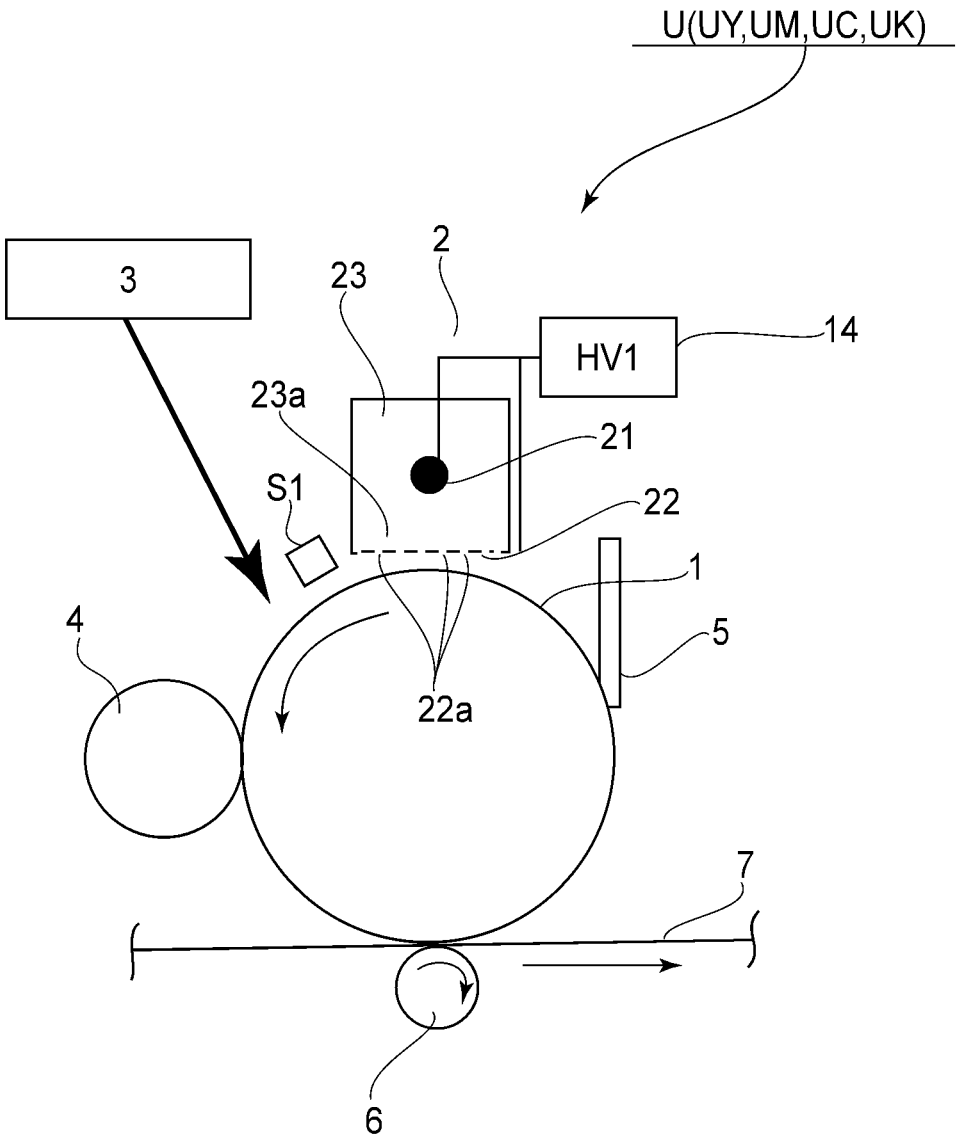
FIG. 12 is a partially schematic view of an image forming apparatus in Embodiment 5.

As shown in FIG. 12, in this embodiment, the discharging device 9 provided as in Embodiments 1 to 3 is not provided. For that reason, in this embodiment, in the case where the photosensitive member cleaning control is executed after the grid cleaning is executed, the exposure device 3 for forming the electrostatic image by exposing the photosensitive member to light during the image formation is used as the discharging portion.

When description is made using the flowchart of FIG. 6 shown in the description of Embodiment 1, specifically, in the photosensitive member cleaning execution (S106) shown in FIG. 6, a step such that the discharge is made by irradiating the photosensitive member with light by the exposure device 3 in a state in which the photosensitive member 1 is charged by applying the high voltage to the charger 2 while rotating the photosensitive member 1 and the belt 7 and by re-charging is carried out again is repeated.

Figure 13:
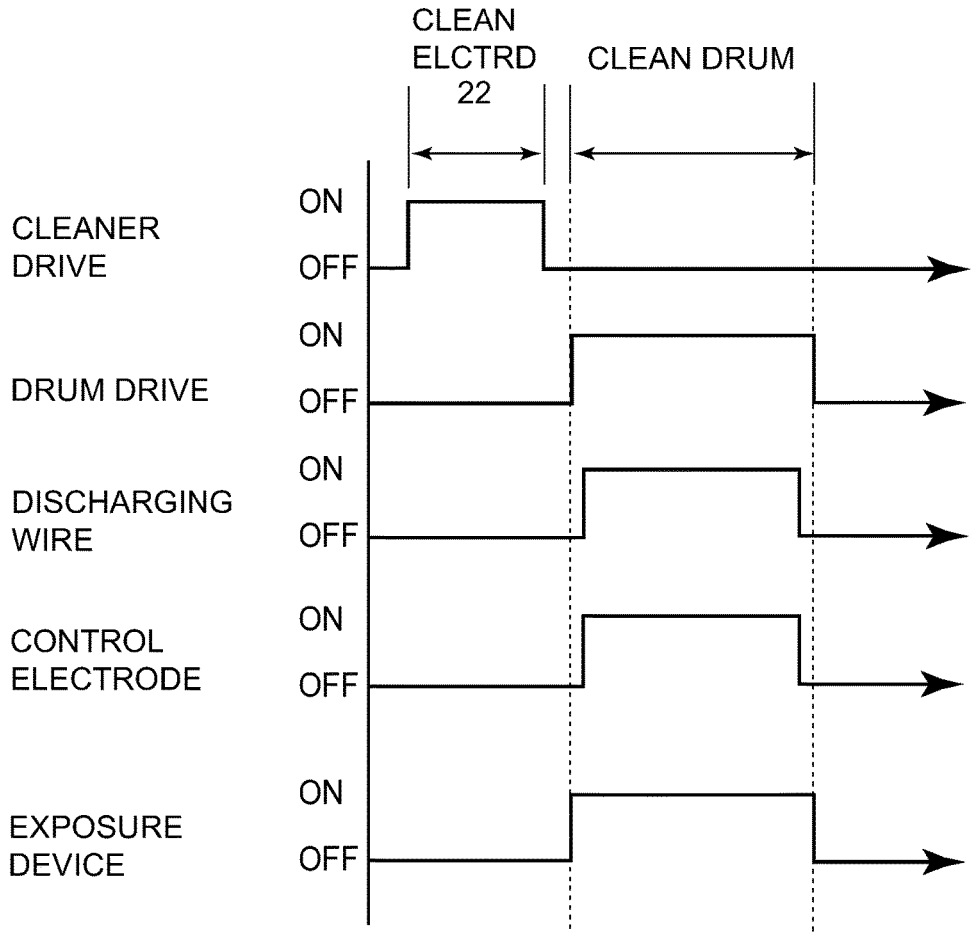
FIG. 13 is a chart showing timing in Embodiment 4.

FIG. 13 is a diagram showing timing in this embodiment. As shown in FIG. 13, during execution of the cleaning of the photosensitive member, the surface of the photosensitive member is discharged by irradiating the photosensitive member with light by the exposure device 3. As in Embodiment 1, when the control is forcedly interrupted during the image formation, i.e., in the case where the grid cleaning is made by interrupting the operation for continuously forming toner images on a plurality of sheets P and thereafter the photosensitive member cleaning control is carried out, the interrupted image formation is resumed when the photosensitive member cleaning control is ended. When the image formation is resumed, the exposure device 3 is used for forming the electrostatic image on the photosensitive member.

<Other Matters>

In the present invention, the image forming apparatus is not limited to the full-color electrophotographic image forming apparatus of the tandem type and of the intermediary transfer type in the embodiments. An apparatus constitution in which the sheet is successively passed through transfer positions of a plurality of image forming portions provided in a tandem arrangement, and color toner images are successively transferred superposedly onto the sheet and then a full-color image-formed product is outputted may also be employed. Further, the image forming apparatus may also be a monochromatic (single-color) image forming apparatus in which only a single photosensitive member is provided for forming a monochromatic image.

INDUSTRIAL APPLICABILITY

According to the present invention, there is provided an image forming apparatus capable of suppressing generation of an image defect after an end of grid cleaning in a high-humidity environment.

EXPLANATION OF SYMBOLS

1 . . . photosensitive member, 2 . . . corona charger, 21 . . . discharge electrode, 22 . . . grid electrode, 22*a* . . . plurality of through holes, 25 . . . cleaning means, 3, 4 . . . toner image forming means, 6 . . . transfer means, 7 . . . transfer-receiving medium, 9 . . . discharging means, 112 (11, 12) . . . detecting means for detecting temperature/humidity information, 101 . . . control means

The invention claimed is:

1. An image forming apparatus comprising:

a rotatable photosensitive member;

a corona charger including a plate-like grid electrode provided with a plurality of through holes and configured to electrically charge said photosensitive member at a charging portion;

a toner image forming portion configured to form a toner image on said photosensitive member electrically charged by said corona charger;

a discharging portion configured to discharge said photosensitive member by irradiating said photosensitive member with light;

a blade configured to clean a surface of said photosensitive member by rubbing the surface of said photosensitive member;

a cleaning member configured to clean the grid electrode by rubbing the grid electrode;

a controller configured to effect control so as to execute an operation in a first cleaning mode and a second cleaning mode, wherein in the first cleaning mode, the grid electrode is cleaned by said cleaning member, and in the second cleaning mode, said photosensitive member is charged by said corona charger and discharged by said discharging portion during rotation of said photosensitive member for a predetermined period; and an acquiring portion configured to acquire information on an amount of water content in air, wherein in a case that said controller effects control so as to execute the operation in the first cleaning mode after an operation of continuously forming toner images on a plurality of recording materials is interrupted and before the operation of continuously forming toner images is resumed, said controller effects control so as to start to execute:

(a) the operation in the second cleaning mode after an end of the operation in the first cleaning mode and before a start of the resumption of toner image formation, in a case that the amount of water content in air, based on the information acquired by said acquiring portion, is not less than a predetermined value, and (b) the operation of forming toner images after an end of the operation in the first cleaning mode without executing the operation in the second cleaning mode, in a case that the amount of water content in air, based on the information acquired by said acquiring portion, is less than the predetermined value.

2. An image forming apparatus according to claim 1, wherein the grid electrode includes a layer containing tetrahedral amorphous carbon at a surface thereof.

3. An image forming apparatus according to claim 1, further comprising a charging time acquiring portion configured to acquire information corresponding to a cumulative time in which said photosensitive member is electrically charged by said corona charger, wherein in a case that said controller effects control so as to execute the operation in the first cleaning mode after an operation of continuously forming toner images on a plurality of recording materials is interrupted and before the operation of continuously forming toner images is resumed, said controller effects control so as to start to execute:

(c) the operation in the second cleaning mode after the end of the operation in the first cleaning mode and before the start of the resumption of toner image formation, in a case that the amount of water content, based on the information acquired by said acquiring portion, is not less than the predetermined value and the cumulative charging time acquired by said charging time acquiring portion is not less than a predetermined time, (d) the operation of forming toner images after the end of the operation in the first cleaning mode, in a case that the amount of water content in air, based on the information acquired by said acquiring portion, is not less than the predetermined value and the cumulative charging time acquired by said charging time acquiring portion is less than the predetermined time, and (e) the operation of forming toner images after the end of the operation in the first cleaning mode, in a case that the amount of water content in air, based on the information acquired by said acquiring portion, is less than the predetermined value regardless of the cumulative charging time acquired by said charging time acquiring portion.

4. An image forming apparatus according to claim 3, wherein said charging time acquiring portion acquires a time of energization to said corona charger as the cumulative charging time.

5. An image forming apparatus according to claim 1, wherein said discharging portion is an exposure device provided in said toner image forming portion and configured to form an electrostatic image by exposing to light said photosensitive member electrically charged by said corona charger before the toner image is formed on said photosensitive member.

6. An image forming apparatus comprising:

a rotatable photosensitive member;

a corona charger including a plate-like grid electrode provided with a plurality of through holes and configured to electrically charge said photosensitive member at a charging portion;

a toner image forming portion configured to form a toner image on said photosensitive member electrically charged by said corona charger;

a discharging portion configured to discharge said photosensitive member by irradiating said photosensitive member with light;

a blade configured to clean a surface of said photosensitive member by rubbing the surface of said photosensitive member;

a cleaning member configured to clean the grid electrode by rubbing the grid electrode;

a controller configured to effect control so as to execute an operation in a first cleaning mode and a second cleaning mode, wherein in the first cleaning mode, the grid electrode is cleaned by said cleaning member, in the second cleaning mode, said photosensitive member is charged by said corona charger and discharged by said discharging portion during rotation of said photosensitive member for a predetermined period; and an acquiring portion configured to acquire information on an amount of water content in air, wherein in a case that said controller effects control so as to execute the operation in the first cleaning mode after toner image formation is ended before shifting to a stand-by mode, in which said image forming apparatus awaits start of image formation in a state that rotation of said photosensitive member is stopped, said controller effects control so as to start to execute:

(a) the operation in the second cleaning mode after an end of the operation in the first cleaning mode, before a start of the stand-by mode, in a case that the amount of water content in air, based on the information acquired by said acquiring portion, is not less than a predetermined value, and (b) an operation shifting to the stand-by mode after an end of the operation in the first cleaning mode without executing the operation in the second cleaning mode, in a case that the amount of water content in air, based on the information acquired by said acquiring portion, is less than the predetermined value.

7. An image forming apparatus according to claim 6, wherein the grid electrode includes a layer containing tetrahedral amorphous carbon at a surface thereof.

8. An image forming apparatus according to claim 6, further comprising a charging time acquiring portion configured to acquire information corresponding to a cumulative time in which said photosensitive member is electrically charged by said corona charger, wherein in a case that said controller effects control so as to execute the operation in the first cleaning mode after toner image formation is ended and before the stand-by mode is started, said controller effects control so as to start to execute:

(c) the operation in the second cleaning mode after an end of the operation in the first cleaning mode, before a start of the stand-by mode, in a case that the amount of water content in air, based on the information acquired by said acquiring portion, is not less than the predetermined value and the cumulative charging time acquired by said charging time acquiring portion is not less than a predetermined time, (d) the operation shifting to the stand-by mode after an end of the operation in the first cleaning mode, in a case that the amount of water content in air, based on the information acquired by said acquiring portion, is not less than the predetermined value and the cumulative charging time acquired by said charging time acquiring portion is less than the predetermined time, and (e) the operation shifting to the stand-by mode after an end of the operation in the first cleaning mode, in a case that the amount of water content in air, based on the information acquired by said acquiring portion, is less than the predetermined value regardless of the cumulative charging time acquired by said charging time acquiring portion.

9. An image forming apparatus according to claim 8, wherein said charging time acquiring portion acquires a time of energization to said corona charger as the cumulative charging time.

10. An image forming apparatus according to claim 6, wherein said discharging portion is an exposure device provided in said toner image forming portion and configured to form an electrostatic image by exposing to light said photosensitive member electrically charged by said corona charger before the toner image is formed on said photosensitive member.

* * * * *